US010978016B2

(12) United States Patent
Li

(10) Patent No.: US 10,978,016 B2
(45) Date of Patent: Apr. 13, 2021

(54) GATE DRIVER ON ARRAY CIRCUIT AND LIQUID CRYSTAL DISPLAY DEVICE HAVING THE GATE DRIVER ON ARRAY CIRCUIT

(71) Applicant: SHENZHEN CHINA STAR OPTOELECTRONICS SEMICONDUCTOR DISPLAY TECHNOLOGY CO., LTD., Guangdong (CN)

(72) Inventor: Wenying Li, Guangdong (CN)

(73) Assignee: SHENZHEN CHINA STAR OPTOELECTRONICS SEMICONDUCTOR DISPLAY TECHNOLOGY CO., LTD., Guangdong (CN)

( * ) Notice: Subject to any disclaimer, the term of this patent is extended or adjusted under 35 U.S.C. 154(b) by 234 days.

(21) Appl. No.: 16/314,504

(22) PCT Filed: Sep. 14, 2018

(86) PCT No.: PCT/CN2018/105785
§ 371 (c)(1),
(2) Date: Dec. 31, 2018

(87) PCT Pub. No.: WO2020/019443
PCT Pub. Date: Jan. 30, 2020

(65) Prior Publication Data

US 2020/0365107 A1 Nov. 19, 2020

(30) Foreign Application Priority Data

Jul. 27, 2018 (CN) ..... 201810847157.6

(51) Int. Cl.
*G09G 3/36* (2006.01)

(52) U.S. Cl.
CPC ... *G09G 3/3677* (2013.01); *G09G 2310/0286* (2013.01); *G09G 2310/08* (2013.01)

(58) Field of Classification Search
CPC ..... G09G 2310/0286; G09G 3/3677; G09G 2310/08; G09G 2300/0408
(Continued)

(56) References Cited

U.S. PATENT DOCUMENTS

2010/0309191 A1 12/2010 Hsu et al.
2013/0222357 A1* 8/2013 Tseng ..... G09G 3/3677 345/212

(Continued)

FOREIGN PATENT DOCUMENTS

CN 104851403 A 8/2015
CN 105139816 A 12/2015

(Continued)

OTHER PUBLICATIONS

International Search Report issued in corresponding International Application No. PCT/CN2018/105785, dated Apr. 28, 2019, pp. 1-11.

*Primary Examiner* — Kent W Chang
*Assistant Examiner* — Sujit Shah
(74) *Attorney, Agent, or Firm* — Leong C. Lei

(57) ABSTRACT

Disclosed is a GOA circuit, including GOA units, which are cascade coupled. An nth stage GOA unit charges nth stage, n+1th stage and n+2th stage horizontal scanning lines. The nth stage GOA unit includes a pull-up control circuit, receiving a start signal CT and outputting a pull-up control signal Q(n); a pull-up circuit, receiving Q(n), an nth stage clock signal CK(n), an n+1th stage clock signal CK(n+1) and an n+2th stage clock signal CK(n+2), and outputting an nth stage transfer signal ST(n), an nth stage scan driving signal G(n), an n+1th stage scan driving signal G(n+1) and (Continued)

an n+2th stage scan driving signal G(n+2); a pull-down circuit, receiving an n+6th stage scan driving signal G(n+6) and a first direct current low voltage signal VSSQ1 to enable Q(n) in an off state. Three stages scan driving signals can be outputted through one stage GOA unit.

16 Claims, 4 Drawing Sheets

(58) Field of Classification Search
USPC ..... 345/92
See application file for complete search history.

(56) References Cited

U.S. PATENT DOCUMENTS

| | | | | |
|---|---|---|---|---|
| 2015/0029083 | A1* | 1/2015 | He | G09G 3/3659 345/100 |
| 2016/0189649 | A1* | 6/2016 | Xiao | G09G 3/3677 345/214 |
| 2017/0287425 | A1* | 10/2017 | Koo | G09G 3/3696 |
| 2018/0301101 | A1* | 10/2018 | Hu | G11C 19/28 |

FOREIGN PATENT DOCUMENTS

| | | | |
|---|---|---|---|
| CN | 105280153 | A | 1/2016 |
| CN | 105390116 | A | 3/2016 |
| CN | 107316603 | A | 11/2017 |
| CN | 107369426 | A | 11/2017 |
| CN | 108154835 | A | 6/2018 |

* cited by examiner

GATE DRIVER ON ARRAY CIRCUIT AND LIQUID CRYSTAL DISPLAY DEVICE HAVING THE GATE DRIVER ON ARRAY CIRCUIT

CROSS REFERENCE

This application is a National Phase of International Application Number PCT/CN2018/105785, filed Sep. 14, 2018, and claims the priority of Chinese Patent Application No. 201810847157.6, entitled "Gate driver on array circuit and liquid crystal display device having the gate driver on array circuit", filed on Jul. 27, 2018, the disclosure of which is incorporated herein by reference in its entirety.

FIELD OF THE INVENTION

The present invention relates to a liquid crystal display field, and more particularly to a gate driver on array (GOA) circuit and a liquid crystal display device having the gate driver on array circuit.

BACKGROUND OF THE INVENTION

The liquid crystal display possesses advantages of being thin and light, energy-saving, and having radiation index generally lower than that of a CRT (Cathode Ray Tube) display, so that it gradually replaces the CRT display and realizes wide application in various electronic products. The driving of horizontal scan line in the present active liquid crystal display is mainly accomplished by an external Integrated Circuit (IC) of a panel. The external IC can control the charge and discharge stage by stage of the level scan lines of respective stages. The GOA technology is to use a TFT (Thin Film Transistor) liquid crystal display array process to fabricate gate scan driving signal circuit on the array substrate, thereby implementing a drive mode of a gate progressive scan. Therefore, the driving circuit of the horizontal scan line can be fabricated on the substrate around the display area by using the original process of the liquid crystal display panel. The GOA technology can reduce the bonding procedure of the external IC and has potential to raise the productivity and to lower the production cost. Meanwhile, it can make the liquid crystal display panel more suitable to the narrow frame or non frame design of display products.

The main architecture of the GOA circuit includes a pull-up control circuit, a pull-up circuit, a pull-down circuit and a pull-down holding circuit. The pull-up circuit is used to output a clock signal as a scan driving signal. The pull-up control circuit is used to output a pull-up control signal to control an activating time of the pull-up circuit. The pull-down circuit is used to pull down the pull-up control signal and the scan driving signal. The pull-down holding circuit is used to hold the pull-up control signal and the scan driving signal at a low potential. At present, in order to meet the design requirements of the ultra-narrow frame of the liquid crystal display panel, the frame of the liquid crystal display panel is generally smaller and smaller, which requires that a proportion of the frame occupied by the GOA circuit is correspondingly reduced. However, due to the large number of GOA units in the existing GOA circuit, the design difficulty of the GOA circuit is increased, and the circuit design space occupied by the GOA circuit is large, which is disadvantageous for the ultra-narrow frame requirement of the liquid crystal display panel.

SUMMARY OF THE INVENTION

The embodiment of the present invention provides a gate driver on array circuit and a liquid crystal display device having the gate driver on array circuit. Three stages scan driving signals can be outputted through one gate driver on array unit. An average frame space occupied by each stage of the gate driver on array unit can be reduced, thereby meeting an ultra-narrow frame requirement of a liquid crystal display panel.

The embodiment of the present invention provides a gate driver on array circuit, comprising a plurality of gate driver on array units, which are cascade coupled, wherein an nth stage gate driver on array unit charges an nth stage horizontal scanning line, an n+1th stage horizontal scanning line and an n+2th stage horizontal scanning line of a display area of a panel, and the nth stage gate driver on array unit comprises a pull-up control circuit, a pull-up circuit and a pull-down circuit, wherein n is a positive integer; the pull-up control circuit receives a start signal CT, and outputs a pull-up control signal Q(n) according to the start signal CT; the pull-up circuit is electrically connected to the pull-up control circuit to receive the pull-up control signal Q(n), an nth stage clock signal CK(n), an n+1th stage clock signal CK(n+1) and an n+2th stage clock signal CK(n+2), and to output an nth stage transfer signal ST(n), an nth stage scan driving signal G(n), an n+1th stage scan driving signal G(n+1), and an n+2th stage scan driving signal G(n+2) according to the pull-up control signal Q(n), the nth stage clock signal CK(n), the n+1th stage clock signal CK(n+1) and the n+2th stage clock signal CK(n+2); the pull-down circuit is electrically connected to the pull-up control circuit and the pull-up circuit to receive an n+6th stage scan driving signal G(n+6) outputted by an n+6th stage gate driver on array unit and a first direct current low voltage signal VSSQ1, and to pull down the pull-up control signal Q(n) according to the n+6th stage scan driving signal G(n+6) and the first direct current low voltage signal VSSQ1 to enable the pull-up control signal Q(n) in an off state.

When n is greater than or equal to 1 and less than or equal to 4, the start signal CT is an initial signal STV, and the pull-up control circuit outputs the pull-up control signal Q(n) according to the initial signal STV; when n is greater than 4, the start signal CT is an n−4th stage transfer signal ST(n−4) and an n−4th stage scan driving signal G(n−4) output by the n−4th stage gate driver on array unit, and the pull-up control circuit outputs the pull-up control signal Q(n) according to the n−4th stage transfer signal ST(n−4) and the n−4th stage scan driving signal G(n−4).

The pull-up control circuit comprises: a first thin film transistor (T11); wherein when n is greater than or equal to 1 and less than or equal to 4, a control end and a first end of the first thin film transistor (T11) are inputted with the initial signal STV, and a second end of the first thin film transistor is connected to a pull-up control signal point Qn to output the pull-up control signal Q(n) according to the initial signal STV; when n is greater than 4, the control end of the first thin film transistor (T11) is inputted with the n−4th stage transfer signal ST(n−4), and the first end of the first thin film transistor is inputted with the n−4th stage scan driving signal G(n−4), and the second end of the first thin film transistor is connected to the pull-up control signal point Qn to output the pull-up control signal Q(n) according to the n−4th stage transfer signal ST(n−4) and the n−4th stage scan driving signal G(n−4); the pull-up circuit comprises; a second thin film transistor (T22), a third thin film transistor (T21-1), a fourth thin film transistor (T21-2) and a fifth thin film transistor (T21-3); a control end of the second thin film transistor (T22) is electrically connected to the pull-up control signal point Qn to receive the pull-up control signal Q(n), and a first end of the second thin film transistor is inputted with the nth stage clock signal CK(n), and a second end of the second thin film transistor outputs the nth stage transfer signal ST(n) according to the pull-up control signal Q(n) and the nth stage clock signal CK(n); a control end of the third thin film transistor (T21-1) is electrically connected to the pull-up control signal point Qn to receive the pull-up control signal Q(n), and a first end of the third thin film transistor is inputted with the nth stage clock signal CK(n), and a second end of the third thin film transistor is electrically connected to the nth stage horizontal scanning line Gn to output the nth stage scan driving signal G(n) according to the pull-up control signal Q(n) and the nth stage clock signal CK(n); a control end of the fourth thin film transistor (T21-2) is electrically connected to the pull-up control signal point Qn to receive the pull-up control signal Q(n), and a first end of the fourth thin film transistor is inputted with the n+1th stage clock signal CK(n+1), and a second end of the fourth thin film transistor is electrically connected to the n+1th stage scan driving signal line Gn+1 to output the n+1th stage scan driving signal G(n+1) according to the pull-up control signal Q(n) and the n+1th stage clock signal CK(n+1); a control end of the fifth thin film transistor (T21-3) is electrically connected to the pull-up control signal point Qn to receive the pull-up control signal Q(n), and a first end of the fifth thin film transistor is inputted with the n+2th stage clock signal CK(n+2), and a second end of the fifth thin film transistor is electrically connected to the n+2th stage horizontal scanning line Gn+2 to output the n+2th stage scan driving signal G(n+2) according to the pull-up control signal Q(n) and the n+2th stage clock signal CK(n+2); the pull-down circuit comprises: a sixth thin film transistor (T41), and a control end of the sixth thin film transistor is inputted with an n+6th stage scan driving signal G(n+6), and a first end of the sixth thin film transistor is electrically connected to the pull-up control signal point Qn, and a second end of the sixth thin film transistor is inputted with the first direct current low voltage signal VSSQ1, and the sixth thin film transistor (T41) pulls down the pull-up control signal Q(n) according to the n+6th stage scan driving signal G(n+6) and the first direct current low voltage signal VSSQ1 to enable the pull-up control signal Q(n) in the off state.

The nth stage gate driver on array unit further comprises a reset circuit, a first pull-down holding circuit, and a second pull-down holding circuit; the reset circuit is electrically connected to the pull-up control circuit, the pull-up circuit and the pull-down circuit, and the reset circuit receives the initial signal STV and a second direct current low voltage signal VSSG2, and resets the pull-up control signal Q(n) according to the initial signal STV and the second direct current low voltage signal VSSG2; the first pull-down holding circuit is electrically connected to the pull-up control circuit, the pull-up circuit, the pull-down circuit and the reset circuit, and the first pull-down holding circuit receives an n+5th stage clock signal CK(n+5), an n+6th stage clock signal CK(n+6), an n+7th stage clock signal CK(n+7), the n−4th stage transfer signal ST(n−4) and the second direct current low voltage signal VSSG2, and to enable the pull-up control signal Q(n), the nth stage scan driving signal G(n), the n+1th stage scan driving signal G(n+1) and the n+2th stage scan driving signal G(n+2) in the off state according to the n+5th stage clock signal CK(n+5), the n+6th stage clock signal CK(n+6), the n+7th stage clock signal CK(n+7), the n−4th stage transfer signal ST(n−4) and the second direct current low voltage signal VSSG2; the second pull-down holding circuit is electrically connected to the pull-up control circuit, the pull-up circuit, the pull-down circuit, the reset circuit and the first pull-down holding circuit, and the second pull-down holding circuit receives a pull-down holding signal PDH, the first direct current low-voltage signal VSSQ1 and the second direct current low-voltage signal VSSG2 to enable the pull-up control signal Q(n), the nth stage scan driving signal G(n), the n+1th stage scan driving signal G(n+1) and the n+2th stage scan driving signal G(n+2) in the off state according to the pull-down holding signal PDH, the first direct current low-voltage signal VSSQ1 and the second direct current low-voltage signal VSSG2.

The reset circuit comprises: a seventh thin film transistor Txo, and a control end is inputted with the initial signal STV, and a first end of the seventh thin film transistor is electrically connected to the pull-up control signal point Qn, and a second end of the seventh thin film transistor is inputted with the second direct current low voltage signal VSSG2 to reset a potential of the pull-up control signal point Qn according to the initial signal STV and the second direct current low voltage signal VSSG2 after the gate driver on array circuit operates for one cycle; the first pull-down holding circuit comprises: an eighth thin film transistor (T43-1), a ninth thin film transistor (T33-1), a tenth thin film transistor (T43-2), an eleventh thin film transistor (T33-2), a twelfth thin film transistor (T43-3) and a thirteenth thin film transistor (T33-3); a control end of the eighth thin film transistor (T43-1) is inputted with the n+5th stage clock signal CK(n+5), and a first end of the eighth thin film transistor is electrically connected to the pull-up control signal point Qn, and a second end of the eighth thin film transistor is inputted with the n−4th stage transfer signal ST(n−4), and the eighth thin film transistor (T43-1) to hold the pull-up control signal Q(n) in the off state according to the n+5th stage clock signal CK(n+5) and the n−4th stage transfer signal ST(n−4); a control end of the ninth thin film transistor (T33-1) is inputted with the n+5th stage clock signal CK(n+5), and a first end of the ninth thin film transistor is electrically connected to the nth stage horizontal scanning line Gn, and a second end of the ninth thin film transistor is inputted with the first direct current low voltage signal VSSQ1, and the ninth thin film transistor (T33-1) holds the nth stage scan driving signal G(n) in the off state according to the n+5th stage clock signal CK(n+5) and the first direct current low voltage signal VSSQ1; a control end of the tenth thin film transistor (T43-2) inputs an n+6th stage clock signal CK(n+6), and a first end of the tenth thin film transistor is electrically connected to the pull-up control signal point Qn, and a second of the tenth thin film transistor is inputted with the n−4th stage transfer signal ST(n−4), and the tenth thin film transistor (T43-2) holds the pull-up control signal Q(n) in the off state according to the n+6th stage clock signal CK(n+6) and the n−4th stage transfer signal ST(n−4); a control end of the eleventh thin film transistor (T33-3) is inputted with the n+6th stage clock signal CK(n+6), and a first end of the eleventh thin film transistor is electrically connected to the n+1th stage horizontal scanning line Gn+1, and a second end of the eleventh thin film transistor is inputted with the first direct current low voltage signal VSSQ1, and the eleventh thin film transistor (T33-3) holds the n+1th stage scan drive signal G(n+1) in the off state according to the n+6th stage clock signal CK(n+6) and the first direct current low voltage signal VSSQ1; a control end of the twelfth thin film transistor (T43-3) is inputted with the n+7th stage clock signal CK(n+7), and a first end of the twelfth thin film transistor is electrically connected to the pull-up control signal point Qn, and a second end of the twelfth thin film transistor is inputted with the n−4th stage transfer signal ST(n−4), and the twelfth thin film transistor (T43-3) holds the pull-up control signal Q(n) in the off state according to the n+7th stage clock signal CK(n+7) and the n−4th stage transfer signal ST(n−4); a control end of the thirteenth thin film transistor (T33-3) is inputted with the n+7th stage clock signal CK(n+7), a first end of the thirteenth thin film transistor is electrically connected to the n+2th stage horizontal scanning line Gn+2, a second end of the thirteenth thin film transistor is inputted with the first direct current low voltage signal VSSQ1, and the thirteenth thin film transistor (T33-3) holds the n+2th stage scan drive signal G(n+2) in the off state according to the n+7th stage clock signal CK(n+7) and the first direct current low voltage signal VSSQ1.

In one embodiment of the present invention, the pull-down holding signal PDH is a direct current high voltage signal VGH; the second pull-down holding circuit comprises: a fourteenth thin film transistor (T51), a fifteenth thin film transistor (T52), a sixteenth thin film transistor (T53), a seventeenth thin film transistor (T54), an eighteenth thin film transistor (T42), a nineteenth thin film transistor (T32-1), a twentieth thin film transistor (T32-2) and a twenty-first thin film transistor (T32-3); a control end and a first end of the fourteenth thin film transistor (T51) are inputted with the direct current high voltage signal VGH, and a second end of the fourteenth thin film transistor is electrically connected to a first signal point Nn; a control end of the fifteenth thin film transistor (T52) is electrically connected to the pull-up control signal point Qn, and a first end of the fifteenth thin film transistor is electrically connected to the first signal point Nn, and a second end of the fifteenth thin film transistor is inputted with the first direct current low voltage signal VSSQ1; a control end of the sixteenth thin film transistor (T53) is electrically connected to the first signal point Nn, and a first end of the sixteenth thin film transistor is inputted with the direct current high voltage signal VGH, and a second end of the sixteenth thin film transistor is electrically connected to a second signal point Pn, and a control end of the seventeenth thin film transistor (T54) is electrically connected to the pull-up control signal point Qn, and a first end of the seventeenth thin film transistor is electrically connected to the second signal point Pn, and a second end of the seventeenth thin film transistor is inputted with the first direct current low voltage signal VSSQ1; a control end of the eighteenth thin film transistor (T42) is electrically connected to the second signal point Pn, and a first end of the eighteenth thin film transistor is electrically connected to the pull-up control signal point Qn, and a second end of the eighteenth thin film transistor is inputted with the first direct current low voltage signal VSSQ1, and the eighteenth thin film transistor (T42) holds the pull-up control signal Q(n) in the off state according to the direct current high voltage signal VGH and the first direct current low voltage signal VSSQ1; a control end of the nineteenth thin film transistor (T32-1) is electrically connected to the second signal point Pn, and a first end of the nineteenth thin film transistor is electrically connected to the nth stage horizontal scanning line Gn, and a second end of the nineteenth thin film transistor is inputted with the second direct current low voltage signal VSSG2, and the nineteenth thin film transistor (T32-1) holds the nth stage scan driving signal G(n) in the off state according to the direct current high voltage signal VGH and the second direct current low voltage signal VSSG2; a control end of the twentieth thin film transistor (T32-2) is electrically connected to the second signal point Pn, and a first end of the twentieth thin film transistor is electrically connected to the n+1th stage horizontal scanning line Gn+1, and a second end of the twentieth thin film transistor is inputted with the second direct current low voltage signal VSSG2, and the twentieth thin film transistor (T32-2) holds the n+1th stage scan driving signal G(n+1) in the off state according to the direct current high voltage signal VGH and the second direct current low voltage signal VSSG2; a control end of the twenty-first thin film transistor (T32-3) is electrically connected to the second signal point Pn, and a first end of the twenty-first thin film transistor is electrically connected to the n+2th stage horizontal scanning line Gn+2, and a second end of the twenty-first thin film transistor is inputted with the second direct current low voltage signal VSSG2, and the twenty-first thin film transistor (T32-3) holds the n+2th stage scan driving signal G(n+2) in the off state according to the direct current high voltage signal VGH and the second direct current low voltage signal VSSG2:

In one embodiment of the present invention, the pull-down holding signal PDH is a direct current high voltage signal VGH; the second pull-down holding circuit comprises: a fourteenth thin film transistor (T51), a fifteenth thin film transistor (T52), a sixteenth thin film transistor (T53), a seventeenth thin film transistor (T54), an eighteenth thin film transistor (T42), a nineteenth thin film transistor (T32-1), a twentieth thin film transistor (T32-2), a twenty-first thin film transistor (T32-3) and a twenty-second thin film transistor (T42-1); a control end and a first end of the fourteenth thin film transistor (T51) are inputted with the direct current high voltage signal VGH, and a second end of the fourteenth thin film transistor is electrically connected to a first signal point Nn; a control end of the fifteenth thin film transistor (T52) is electrically connected to the pull-up control signal point Qn, and a first end of the fifteenth thin film transistor is electrically connected to the first signal point Nn, and a second end of the fifteenth thin film transistor is inputted with the first direct current low voltage signal VSSQ1; a control end of the sixteenth thin film transistor (T53) is electrically connected to the first signal point Nn, and a first end of the sixteenth thin film transistor is inputted with the direct current high voltage signal VGH, and a second end of the sixteenth thin film transistor is electrically connected to a second signal point Pn, and a control end of the seventeenth thin film transistor (T54) is electrically connected to the pull-up control signal point Qn, and a first end of the seventeenth thin film transistor is electrically connected to the second signal point Pn, and a second end of the seventeenth thin film transistor is inputted with the first direct current low voltage signal VSSQ1; a control end of the eighteenth thin film transistor (T42) is electrically connected to the second signal point Pn, and a first end and a second end of the eighteenth thin film transistor are electrically connected to the pull-up control signal point Qn; a control end and a first end of the twenty-second thin film transistor (T42-1) are electrically connected to the pull-up control signal point Qn, and a second end of the twenty-second thin film transistor is inputted with the first direct current low voltage signal VSSQ1, and the eighteenth thin film transistor (T42) and the twenty-second thin film transistor (T42-1) hold the pull-up control signal Q(n) in the off state according to the direct current high voltage signal VGH and the first direct current low voltage signal VSSQ1; a control end of the nineteenth thin film transistor (T32-1) is electrically connected to the second signal point Pn, and a first end of the nineteenth thin film transistor is electrically connected to the nth stage horizontal scanning line Gn, and a second end of the nineteenth thin film transistor is inputted with the second direct current low voltage signal VSSG2, and the nineteenth thin film transistor (T32-1) holds the nth stage scan driving signal G(n) in the off state according to the direct current high voltage signal VGH and the second direct current low voltage signal VSSG2; a control end of the twentieth thin film transistor (T32-2) is electrically connected to the second signal point Pn, and a first end of the twentieth thin film transistor is electrically connected to the n+1th stage horizontal scanning line Gn+1, and a second end of the twentieth thin film transistor is inputted with the second direct current low voltage signal VSSG2, and the twentieth thin film transistor (T32-2) holds the n+1th stage scan driving signal G(n+1) in the off state according to the direct current high voltage signal VGH and the second direct current low voltage signal VSSG2; a control end of the twenty-first thin film transistor (T32-3) is electrically connected to the second signal point Pn, and a first end of the twenty-first thin film transistor is electrically connected to the n+2th stage horizontal scanning line Gn+2, and a second end of the twenty-first thin film transistor is inputted with the second direct current low voltage signal VSSG2, and the twenty-first thin film transistor (T32-3) holds the n+2th stage scan driving signal G(n+2) in the off state according to the direct current high voltage signal VGH and the second direct current low voltage signal VSSG2.

In another embodiment of the present invention, the pull-down holding signal PDH comprises a first low-frequency signal LC1 and a second low-frequency signal LC2, and the second pull-down holding circuit comprises a first pull-down holding module and a second pull-down holding module; the first pull-down holding circuit comprises: a fourteenth thin film transistor (T51), a fifteenth thin film transistor (T52), a sixteenth thin film transistor (T53), a seventeenth thin film transistor (T54), an eighteenth thin film transistor (T42), a nineteenth thin film transistor (T32-1), a twentieth thin film transistor (T32-2) and a twenty-first thin film transistor (T32-3); a control end and a first end of the fourteenth thin film transistor (T51) are inputted with the first low frequency signal LC1, and a second end of the fourteenth thin film transistor is electrically connected to a first signal point Nn; a control end of the fifteenth thin film transistor (T52) is electrically connected to the pull-up control signal point Qn, and a first end of the fifteenth thin film transistor is electrically connected to the first signal point Nn, and a second end of the fifteenth thin film transistor is inputted with the first direct current low voltage signal VSSQ1; a control end of the sixteenth thin film transistor (T53) is electrically connected to the first signal point Nn, and a first end of the sixteenth thin film transistor is inputted with the first low frequency signal LC1, and a second end of the sixteenth thin film transistor is electrically connected to a second signal point Pn, and a control end of the seventeenth thin film transistor (T54) is electrically connected to the pull-up control signal point Qn, and a first end of the seventeenth thin film transistor is electrically connected to the second signal point Pn, and a second end of the seventeenth thin film transistor is inputted with the first direct current low voltage signal VSSQ1; a control end of the eighteenth thin film transistor (T42) is electrically connected to the second signal point Pn, and a first end of the eighteenth thin film transistor is electrically connected to the pull-up control signal point Qn, and a second end of the eighteenth thin film transistor is inputted with the first direct current low voltage signal VSSQ1, and the eighteenth thin film transistor (T42) holds the pull-up control signal Q(n) in the off state according to the direct current high voltage signal VGH and the first direct current low voltage signal VSSQ1; a control end of the nineteenth thin film transistor (T32-1) is electrically connected to the second signal point Pn, and a first end of the nineteenth thin film transistor is electrically connected to the nth stage horizontal scanning line Gn, and a second end of the nineteenth thin film transistor is inputted with the second direct current low voltage signal VSSG2, and the nineteenth thin film transistor (T32-1) holds the nth stage scan driving signal G(n) in the off state according to the direct current high voltage signal VGH and the second direct current low voltage signal VSSG2; a control end of the twentieth thin film transistor (T32-2) is electrically connected to the second signal point Pn, and a first end of the twentieth thin film transistor is electrically connected to the n+1th stage horizontal scanning line Gn+1, and a second end of the twentieth thin film transistor is inputted with the second direct current low voltage signal VSSG2, and the twentieth thin film transistor (T32-2) holds the n+1th stage scan driving signal G(n+1) in the off state according to the direct current high voltage signal VGH and the second direct current low voltage signal VSSG2; a control end of the twenty-first thin film transistor (T32-3) is electrically connected to the second signal point Pn, and a first end of the twenty-first thin film transistor is electrically connected to the n+2th stage horizontal scanning line Gn+2, and a second end of the twenty-first thin film transistor is inputted with the second direct current low voltage signal VSSG2, and the twenty-first thin film transistor (T32-3) holds the n+2th stage scan driving signal G(n+2) in the off state according to the direct current high voltage signal VGH and the second direct current low voltage signal VSSG2; the second pull-down holding module includes: a twenty-third thin film transistor (T61), a twenty-fourth thin film transistor (T62), a twenty-fifth thin film transistor (T63), and a twenty-sixth thin film transistor (T64), a twenty-seventh thin film transistor (T44), a twenty-eighth thin film transistor (T34-1), a twenty-ninth thin film transistor (T34-2) and a thirtieth thin film transistor (T34-3); a control end and a first end of the twenty-third thin film transistor (T61) are inputted with the second low frequency signal LC2, and a second end of the twenty-third thin film transistor is electrically connected to a third signal point Sn; a control end of the twenty-fourth thin film transistor (T62) is electrically connected to the pull-up control signal point Qn, a first end of the twenty-fourth thin film transistor is electrically connected to the third signal point Sn, and a second end of the twenty-fourth thin film transistor is input to the first direct current low voltage signal VSSQ1; a control end of the twenty-fifth thin film transistor (T63) is electrically connected to the third signal point Sn, and a first end of the twenty-fifth thin film transistor is inputted with the second low frequency signal LC2, and a second end of the twenty-fifth thin film transistor is electrically connected to a fourth signal point Kn; a control end of the twenty-sixth thin film transistor (T64) is electrically connected to the pull-up control signal point Qn, and a first end of the twenty-sixth thin film transistor is electrically connected to the fourth signal point Kn, and a second end of the twenty-sixth thin film transistor is inputted with the first direct current low voltage signal VSSQ1; a control end of the twenty-seventh thin film transistor (T44) is electrically connected to the fourth signal point Kn, and a first end of the twenty-seventh thin film transistor is electrically connected to the pull-up control signal point Qn, and a second end of the twenty-seventh thin film transistor is inputted with the first direct current low voltage signal VSSQ1 and the twenty-seventh thin film transistor (T44) holds the pull-up control signal Q(n) in the off state according to the second low frequency signal LC2 and the first direct current low voltage signal VSSQ1; a control end of the twenty-eighth thin film transistor (T34-1) is electrically connected to the fourth signal point Kn, and a first end of the twenty-eighth thin film transistor is electrically connected to the nth stage horizontal scanning line Gn, and a second end of the twenty-eighth thin film transistor is inputted with the second direct current low voltage signal VSSG2, and the twenty-eighth thin film transistor (T34-1) holds the nth stage scan driving signal G(n) in the off state according to the second low frequency signal LC2 and the second direct current low voltage signal VSSG2; a control end of the twenty-ninth thin film transistor (T34-2) is electrically connected to the fourth signal point Kn, and a first end of the twenty-ninth thin film transistor is electrically connected to the n+1th stage horizontal scanning line Gn+1, and a second end of the twenty-ninth thin film transistor is inputted with the second direct current low voltage signal VSSG2, and the twenty-ninth thin film transistor (T34-2) holds the n+1th stage scan driving signal G(n+1) according to the second low frequency signal LC2 and the second direct current low voltage signal VSSG2; a control end of the thirtieth thin film transistor (T34-3) is electrically connected to the fourth signal point Kn, and a first end of the thirtieth thin film transistor is electrically connected to the n+2th stage horizontal scanning line Gn+2, and a second end of the thirtieth thin film transistor is inputted with the second direct current low voltage signal VSSG2, and the thirtieth thin film transistor (T34-3) holds the n+2th stage scan driving signal Q(n+2) according to the fourth signal point Kn and the second direct current low voltage signal VSSG2.

The first pull-down holding module and the second pull-down holding module alternately function to hold the pull-up control signal Q(n), the nth stage scan driving signal Q(n), the n+1th stage scan driving signal Q(n+1) and the n+2th stage scan driving signal Q(n+2) in the off state.

Correspondingly, the embodiment of the present invention further provides a liquid crystal display device, including the aforesaid gate driver on array applied for liquid crystal display.

In conclusion, in the gate driver on array circuit and the liquid crystal display device having the gate driver on array circuit provided by the embodiment of the present invention, by outputting three stages scan driving signals through one gate driver on array unit, the average frame space occupied by each stage of the gate driver on array unit can be reduced, thereby meeting the ultra-narrow frame requirement of the liquid crystal display panel.

BRIEF DESCRIPTION OF THE DRAWINGS

In order to more clearly illustrate the embodiments of the present invention or prior art, the following figures will be described in the embodiments are briefly introduced. It is obvious that the drawings are merely some embodiments of the present invention, those of ordinary skill in this field can obtain other figures according to these figures without paying the premise.

DETAILED DESCRIPTION OF PREFERRED EMBODIMENTS

For better explaining the technical solution and the effect of the present invention, the present invention will be further described in detail with the accompanying drawings in the specific embodiments. It is clear that the described embodiments are part of embodiments of the present application, but not all embodiments. Based on the embodiments of the present invention, all other embodiments to those of ordinary skill in the premise of no creative efforts obtained, should be considered within the scope of protection of the present invention.

Besides, the following descriptions for the respective embodiments are specific embodiments capable of being implemented for illustrations of the present invention with referring to appended figures. For example, the terms of up, down, front, rear, left, right, interior, exterior, side, etcetera are merely directions of referring to appended figures. Therefore, the wordings of directions are employed for explaining and understanding the present invention but not limitations thereto.

In the description of the invention, which needs explanation is that the term "installation", "connected", "connection" should be broadly understood unless those are clearly defined and limited, otherwise. For example, those can be a fixed connection, a detachable connection, or an integral connection; those can be a mechanical connection, or an electrical connection; those can be a direct connection, or an indirect connection with an intermediary, which may be an internal connection of two elements. To those of ordinary skill in the art, the specific meaning of the above terminology in the present invention can be understood in the specific circumstances.

Besides, in the description of the present invention, unless with being indicated otherwise, "plurality" means two or more. In the present specification, the term "process" encompasses an independent process, as well as a process that cannot be clearly distinguished from another process but yet achieves the expected effect of the process of interest. Moreover, in the present specification, any numerical range expressed herein using "to" refers to a range including the numerical values before and after "to" as the minimum and maximum values, respectively. In figures, the same reference numbers will be used to refer to the same or like parts.

The embodiment of the present invention provides a GOA (gate driver on array) circuit. Three stages scan driving signals can be outputted through one gate driver on array unit. An average frame space occupied by each stage of the gate driver on array unit can be reduced, thereby meeting an ultra-narrow frame requirement of a liquid crystal display panel. A GOA circuit and a liquid crystal display device having the GOA circuit according to an embodiment of the present invention will be specifically described below with reference to FIG. 1 to FIG. 7.

Figure 1:
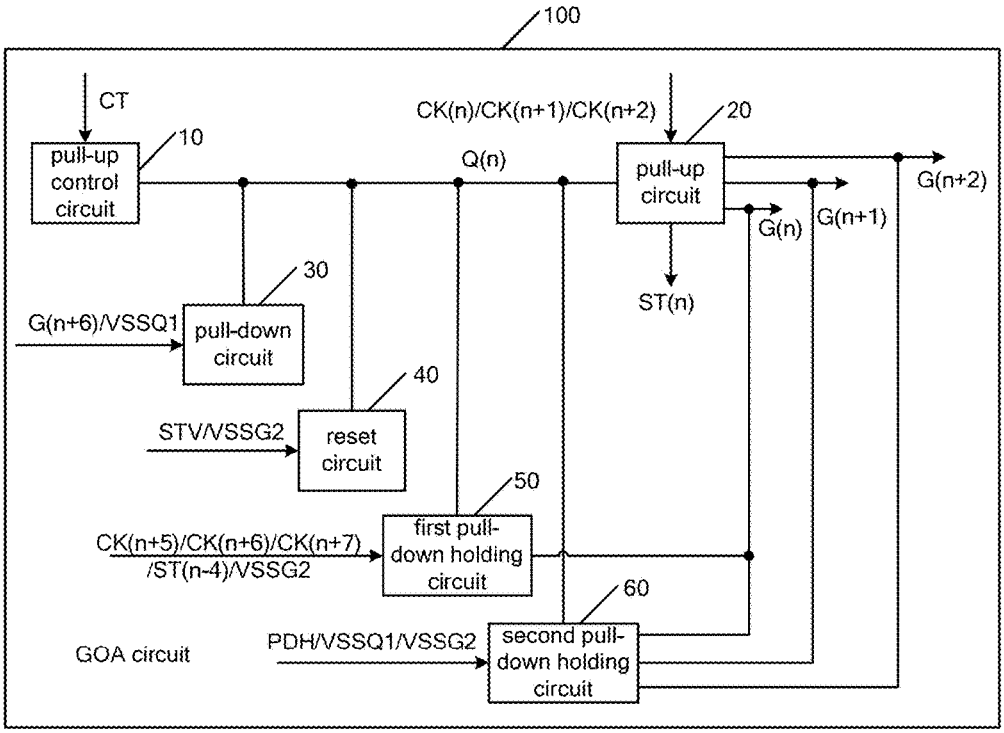
FIG. 1 is a block diagram of a gate driver on array circuit according to an embodiment of the present invention.

Please refer to FIG. 1. FIG. 1 is a circuit block diagram of a gate driver on array circuit according to an embodiment of the present invention. The gate driver on array circuit 100 shown in FIG. 1 includes a plurality of gate driver on array units, which are cascade coupled, wherein an nth stage gate driver on array unit charges an nth stage horizontal scanning line, an n+1th stage horizontal scanning line and an n+2th stage horizontal scanning line of a display area of a liquid crystal display panel, and the nth stage gate driver on array unit at least includes a pull-up control circuit 10, a pull-up circuit 20, a pull-down circuit 30, a reset circuit 40, a first pull-down holding circuit 50 and a second pull-down holding circuit 60 wherein n is a positive integer.

The pull-up control circuit 10 receives a start signal CT, and outputs a pull-up control signal Q(n) according to the start signal CT.

Specifically, when 1≤n≤4, i.e. n is greater than or equal to 1 and less than or equal to 4, the start signal CT is an initial signal STV, and the pull-up control circuit 10 outputs the pull-up control signal Q(n) according to the initial signal STV; when n>4, i.e. n is greater than 4, the start signal CT is an n−4th stage transfer signal ST(n−4) and an n−4th stage scan driving signal G(n−4) output by the n−4th stage gate driver on array unit, and the pull-up control circuit 10 outputs the pull-up control signal Q(n) according to the n−4th stage transfer signal ST(n−4) and the n−4th stage scan driving signal G(n−4).

Thus, when 1≤n≤4, the initial signal STV is responsible for starting a first stage GOA unit, a second stage GOA unit, a third stage GOA unit and a fourth stage GOA unit; when n>4, the nth stage GOA unit is activated by the n−4th stage transfer signal ST(n−4) and the n−4th stage scan driving signal G(n−4) output by the n−4th stage GOA unit, thereby, to realize activating the GOA circuit 100 stage by stage, and the row scan driving, so that the horizontal scan lines can be charged stage by stage.

the pull-up circuit 20 is electrically connected to the pull-up control circuit 10 and receives the pull-up control signal Q(n), an nth stage clock signal CK(n), an n+1th stage clock signal CK(n+1) and an n+2th stage clock signal CK(n+2), and to output an nth stage transfer signal ST(n), an nth stage scan driving signal G(n), an n+1th stage scan driving signal G(n+1), and an n+2th stage scan driving signal G(n+2) according to the pull-up control signal Q(n), the nth stage clock signal CK(n), the n+1th stage clock signal CK(n+1) and the n+2th stage clock signal CK(n+2).

the pull-down circuit 30 is electrically connected to the pull-up control circuit 10 and the pull-up circuit 20 and receives an n+6th stage scan driving signal G(n+6) outputted by an n+6th stage gate driver on array unit and a first direct current low voltage signal VSSQ1, and to pull down the pull-up control signal Q(n) according to the n+6th stage scan driving signal G(n+6) and the first direct current low voltage signal VSSQ1 to enable the pull-up control signal Q(n) in an off state (i.e. low potential).

The reset circuit 40 is electrically connected to the pull-up control circuit 10, the pull-up circuit 20 and the pull-down circuit 30, and the reset circuit 40 receives the initial signal STV and a second direct current low voltage signal VSSG2, and resets the pull-up control signal Q(n) according to the initial signal STV and the second direct current low voltage signal VSSG2.

The first pull-down holding circuit 50 is electrically connected to the pull-up control circuit 10, the pull-up circuit 20, the pull-down circuit 30 and the reset circuit 40, and the first pull-down holding circuit 50 receives an n+5th stage clock signal CK(n+5), an n+6th stage clock signal CK(n+6), an n+7th stage clock signal CK(n+7), the n−4th stage transfer signal ST(n−4) and the second direct current low voltage signal VSSG2, and to enable the pull-up control signal Q(n), the nth stage scan driving signal G(n), the n+1th stage scan driving signal G(n+1) and the n+2th stage scan driving signal G(n+2) in the off state according to the n+5th stage clock signal CK(n+5), the n+6th stage clock signal CK(n+6), the n+7th stage clock signal CK(n+7), the n−4th stage transfer signal ST(n−4) and the second direct current low voltage signal VSSG2.

The second pull-down holding circuit 60 is electrically connected to the pull-up control circuit 10, the pull-up circuit 20, the pull-down circuit 30, the reset circuit 40 and the first pull-down holding circuit 50, and the second pull-down holding circuit 60 receives a pull-down holding signal PDH, the first direct current low-voltage signal VSSQ1 and the second direct current low-voltage signal VSSG2 to enable the pull-up control signal Q(n), the nth stage scan driving signal G(n), the n+1th stage scan driving signal G(n+1) and the n+2th stage scan driving signal G(n+2) in the off state according to the pull-down holding signal PDH, the first direct current low-voltage signal VSSQ1 and the second direct current low-voltage signal VSSG2.

Figure 2:
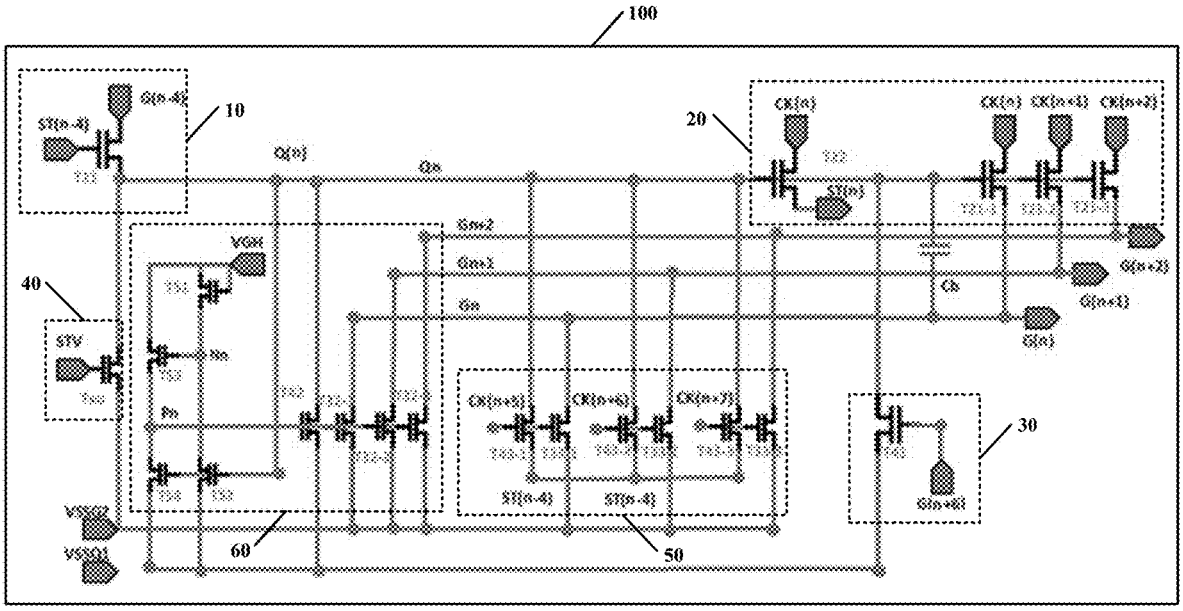
FIG. 2 is a circuit structure diagram of the gate driver on array circuit shown in FIG. 1.

Please refer to FIG. 1 and FIG. 2. FIG. 2 is a circuit structure diagram of the gate driver on array circuit shown in FIG. 1, The GOA circuit 100 shown in FIG. 2 includes, but not limited to, the pull-up control circuit 10, the pull-up circuit 20, the pull-down circuit 30, the reset circuit 40, a first pull-down holding circuit 50 and a second pull-down holding circuit 60 as shown in FIG. 1.

The pull-up control circuit 10 specifically includes: a first thin film transistor T11;

when 1≤n≤4, a control end and a first end of the first thin film transistor T11 are inputted with the initial signal STV, and a second end of the first thin film transistor is connected to a pull-up control signal point Qn to output the pull-up control signal Q(n) according to the initial signal STV;

when n>4, the control end of the first thin film transistor T11 is inputted with the n−4th stage transfer signal ST(n−4), and the first end of the first thin film transistor is inputted with the n−4th stage scan driving signal G(n−4), and the second end of the first thin film transistor is connected to the pull-up control signal point Qn to output the pull-up control signal Q(n) according to the n−4th stage transfer signal ST(n−4) and the n−4th stage scan driving signal G(n−4).

Specifically, only the signal input condition of the pull-up control circuit 10 when n>4 is shown in FIG. 1 and FIG. 2, for instance, only the n−4th stage transfer signal ST(n−4) and the n−4th stage scan drive signal G(n−4) are shown in FIG. 1 and FIG. 2.

The pull-up circuit 20 specifically includes: a second thin film transistor T22, a third thin film transistor T21-1, a fourth thin film transistor T21-2 and a fifth thin film transistor T21-3. The second thin film transistor T22 is configured to output an nth stage transfer signal ST(n) according to the pull-up control signal Q(n); specifically, a control end of the second thin film transistor T22 is electrically connected to the pull-up control signal point Qn to receive the pull-up control signal Q(n), and a first end of the second thin film transistor is inputted with the nth stage clock a signal CK(n), and a second end of the second thin film transistor outputs the nth stage transfer signal ST(n) according to the pull-up control signal Q(n) and the nth stage clock signal CK(n). The third thin film transistor T21-1 is configured to output the nth stage scan driving signal G(n) according to the pull-up control signal Q(n) and the nth stage clock a signal CK(n); specifically, a control end of the third thin film transistor T21-1 is electrically connected to the pull-up control signal point Qn to receive the pull-up control signal Q(n), and a first end of the third thin film transistor is inputted with the nth stage clock a signal CK(n), and a second end of the third thin film transistor is electrically connected to the nth stage horizontal scanning line Gn to output the nth stage scan driving signal G(n) according to the pull-up control signal Q(n) and the nth stage clock a signal CK(n). The fourth thin film transistor T21-2 is configured to output the n+1th stage scan driving signal G(n+1) according to the pull-up control signal Q(n) and the n+1th stage clock signal CK(n+1); specifically, a control end of the fourth thin film transistor T21-2 is electrically connected to the pull-up control signal point Qn to receive the pull-up control signal Q(n), and a first end of the fourth thin film transistor is inputted with the n+1th stage clock signal CK(n+1), and a second end of the fourth thin film transistor is electrically connected to the n+1th stage scan driving signal line Gn+1 to output the n+1th stage scan driving signal G(n+1) according to the pull-up control signal Q(n) and the n+1th stage clock signal CK(n+1). The fifth thin film transistor T21-3 is configured to output the n+2th stage scan driving signal G(n+2) according to the pull-up control signal Q(n) and the n+2th stage clock signal CK(n+2); specifically, a control end of the fifth thin film transistor T21-3 is electrically connected to the pull-up control signal point Qn to receive the pull-up control signal Q(n), and a first end of the fifth thin film transistor is inputted with the n+2th stage clock signal CK(n+2), and a second end of the fifth thin film transistor is electrically connected to the n+2th stage horizontal scanning line Gn+2 to output the n+2th stage scan driving signal G(n+2) according to the pull-up control signal Q(n) and the n+2th stage clock signal CK(n+2).

The pull-down circuit 30 specifically includes: a sixth thin film transistor T41, and a control end of the sixth thin film transistor is inputted with an n+6th stage scan driving signal G(n+6), and a first end of the sixth thin film transistor is electrically connected to the pull-up control signal point Qn, and a second end of the sixth thin film transistor is inputted with the first direct current low voltage signal VSSQ1, and the sixth thin film transistor T41 pulls down the pull-up control signal Q(n) according to the n+6th stage scan driving signal G(n+6) and the first direct current low voltage signal VSSQ1 to enable the pull-up control signal Q(n) in the off state (i.e. low potential).

The second direct current low voltage signal VSSG2 is a direct current low voltage signal required by the liquid crystal display panel. Specifically, the first direct current low voltage signal VSSQ1 is smaller than the second direct current low voltage signal VSSG2, and the setting of the first direct current low voltage signal VSSQ1 may cause the potential of the pull-up control signal point Qn to be pulled lower, which is beneficial to prevent the pull-up control signal point Qn from leaking, and to improve the reliability of the entire GOA circuit 100.

The reset circuit 40 specifically includes: a seventh thin film transistor Txo, and a control end is inputted with the initial signal STV, and a first end of the seventh thin film transistor is electrically connected to the pull-up control signal point Qn, and a second end of the seventh thin film transistor is inputted with the second direct current low voltage signal VSSG2. The seventh thin film transistor Txo is configured to reset a potential of the pull-up control signal point Qn (i.e. to reset the pull-up control signal Q(n)) according to the initial signal STV and the second direct current low voltage signal VSSG2 after the gate driver on array circuit 100 operates for one cycle, which is beneficial for the pull-up control signal point Qn to be discharged faster and better the GOA circuit 100 operates for one cycle, thereby preventing that the potential of the pull-up control signal point Qn cannot be lowered in time to cause a large current during the power on/off of the liquid crystal display panel multiple times, and then causing the LCD panel to be abnormal.

The first pull-down holding circuit 50 includes: an eighth thin film transistor T43-1, a ninth thin film transistor T33-1, a tenth thin film transistor T43-2, an eleventh thin film transistor T33-2, a twelfth thin film transistor T43-3 and a thirteenth thin film transistor T33-3, A control end of the eighth thin film transistor T43-1 is inputted with the n+5th stage clock signal CK(n+5), and a first end of the eighth thin film transistor is electrically connected to the pull-up control signal point Qn, and a second end of the eighth thin film transistor is inputted with the n−4th stage transfer signal ST(n−4), and the eighth thin film transistor T43-1 to hold the pull-up control signal Q(n) in the off state according to the n+5th stage clock signal CK(n+5) and the n−4th stage transfer signal ST(n−4); a control end of the ninth thin film transistor T33-1 is inputted with the n+5th stage clock signal CK(n+5), and a first end of the ninth thin film transistor is electrically connected to the nth stage horizontal scanning line Gn, and a second end of the ninth thin film transistor is inputted with the first direct current low voltage signal VSSQ1, and the ninth thin film transistor T33-1 holds the nth stage scan driving signal G(n) in the off state according to the n+5th stage clock signal CK(n+5) and the first direct current low voltage signal VSSQ1; a control end of the tenth thin film transistor T43-2 inputs an n+6th stage clock signal CK(n+6), and a first end of the tenth thin film transistor is electrically connected to the pull-up control signal point Qn, and a second of the tenth thin film transistor is inputted with the n−4th stage transfer signal ST(n−4), and the tenth thin film transistor T43-2 holds the pull-up control signal Q(n) in the off state according to the n+6th stage clock signal CK(n+6) and the n−4th stage transfer signal ST(n−4); a control end of the eleventh thin film transistor T33-3 is inputted with the n+6th stage clock signal CK(n+6), and a first end of the eleventh thin film transistor is electrically connected to the n+1th stage horizontal scanning line Gn+1, and a second end of the eleventh thin film transistor is inputted with the first direct current low voltage signal VSSQ1, and the eleventh thin film transistor T33-3 holds the n+1th stage scan drive signal G(n+1) in the off state according to the n+6th stage clock signal CK(n+6) and the first direct current low voltage signal VSSQ1; a control end of the twelfth thin film transistor T43-3 is inputted with the n+7th stage clock signal CK(n+7), and a first end of the twelfth thin film transistor is electrically connected to the pull-up control signal point Qn, and a second end of the twelfth thin film transistor is inputted with the n−4th stage transfer signal ST(n−4), and the twelfth thin film transistor T43-3 holds the pull-up control signal Q(n) in the off state according to the n+7th stage clock signal CK(n+7) and the n−4th stage transfer signal ST(n−4); a control end of the thirteenth thin film transistor T33-3 is inputted with the n+7th stage clock signal CK(n+7), a first end of the thirteenth thin film transistor is electrically connected to the n+2th stage horizontal scanning line Gn+2, a second end of the thirteenth thin film transistor is inputted with the first direct current low voltage signal USSQ1, and the thirteenth thin film transistor T33-3 holds the n+2th stage scan drive signal Q(n+2) in the off state according to the n+7th stage clock signal CK(n+7) and the first direct current low voltage signal VSSQ1.

As shown in FIG. 2, in one embodiment of the present invention, the pull-down holding signal PDH is a direct current high voltage signal VGH. The second pull-down holding circuit 60 specifically includes: a fourteenth thin film transistor T51, a fifteenth thin film transistor T52, a sixteenth thin film transistor T53, a seventeenth thin film transistor T54, an eighteenth thin film transistor T42, a nineteenth thin film transistor T32-1, a twentieth thin film transistor T32-2 and a twenty-first thin film transistor T32-3. A control end and a first end of the fourteenth thin film transistor T51 are inputted with the direct current high voltage signal VGH, and a second end of the fourteenth thin film transistor is electrically connected to a first signal point Nn: a control end of the fifteenth thin film transistor T52 is electrically connected to the pull-up control signal point Qn, and a first end of the fifteenth thin film transistor is electrically connected to the first signal point Nn, and a second end of the fifteenth thin film transistor is inputted with the first direct current low voltage signal VSSQ1 a control end of the sixteenth thin film transistor T53 is electrically connected to the first signal point Nn, and a first end of the sixteenth thin film transistor is inputted with the direct current high voltage signal VGH, and a second end of the sixteenth thin film transistor is electrically connected to a second signal point Pn, and a control end of the seventeenth thin film transistor T54 is electrically connected to the pull-up control signal point Qn, and a first end of the seventeenth thin film transistor is electrically connected to the second signal point Pn, and a second end of the seventeenth thin film transistor is inputted with the first direct current low voltage signal VSSQ1; a control end of the eighteenth thin film transistor T42 is electrically connected to the second signal point Pn, and a first end of the eighteenth thin film transistor is electrically connected to the pull-up control signal point Qn, and a second end of the eighteenth thin film transistor is inputted with the first direct current low voltage signal VSSQ1, and the eighteenth thin film transistor T42 holds the pull-up control signal Q(n) in the off state according to the direct current high voltage signal VGH and the first direct current low voltage signal VSSQ1; a control end of the nineteenth thin film transistor 132-1 is electrically connected to the second signal point Pn, and a first end of the nineteenth thin film transistor is electrically connected to the nth stage horizontal scanning line Gn, and a second end of the nineteenth thin film transistor is inputted with the second direct current low voltage signal VSSG2, and the nineteenth thin film transistor T32-1 holds the nth stage scan driving signal G(n) in the off state according to the direct current high voltage signal VGH and the second direct current low voltage signal VSSG2; a control end of the twentieth thin film transistor T32-2 is electrically connected to the second signal point Pn, and a first end of the twentieth thin film transistor is electrically connected to the n+1th stage horizontal scanning line Gn+1, and a second end of the twentieth thin film transistor is inputted with the second direct current low voltage signal VSSG2, and the twentieth thin film transistor T32-2 holds the n+1th stage scan driving signal Q(n+1) in the off state according to the direct current high voltage signal VGH and the second direct current low voltage signal VSSG2; a control end of the twenty-first thin film transistor T32-3 is electrically connected to the second signal point Pn, and a first end of the twenty-first thin film transistor is electrically connected to the n+2th stage horizontal scanning line Gn+2, and a second end of the twenty-first thin film transistor is inputted with the second direct current low voltage signal VSSG2, and the twenty-first thin film transistor T32-3 holds the n+2th stage scan driving signal G(n+2) in the off state according to the direct current high voltage signal VGH and the second direct current low voltage signal VSSG2.

Specifically, in the embodiment of the present invention, the pull-up control signal point Qn is electrically connected to the nth stage horizontal scanning line Gn through a capacitor Cb. The capacitor Cb is a bootstrap capacitor.

Figure 3:
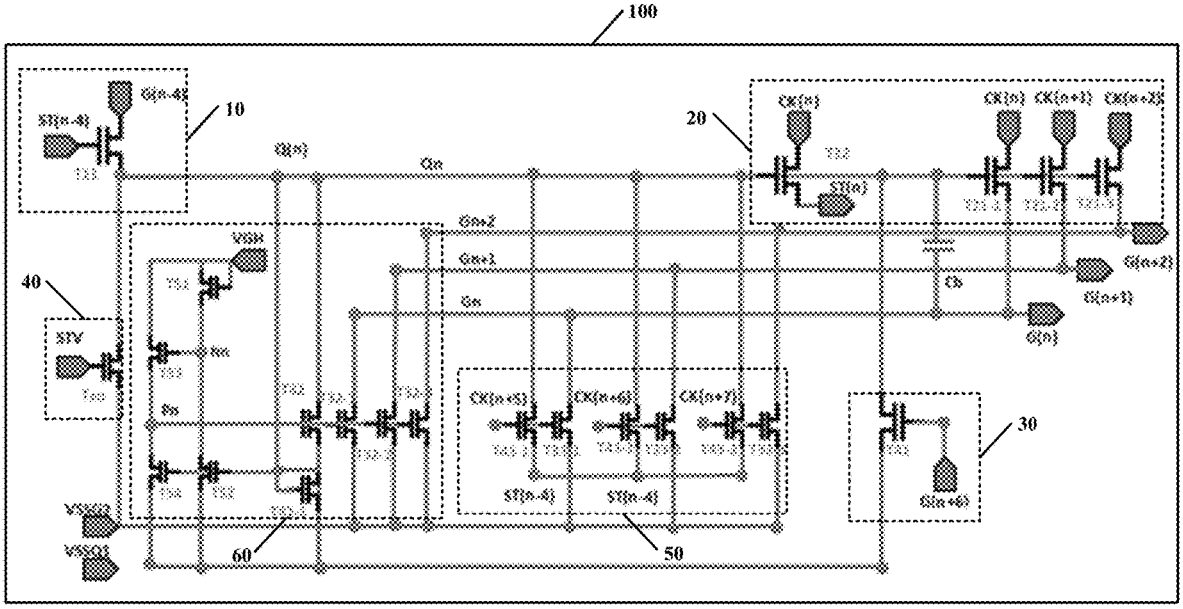
FIG. 3 is another circuit structure diagram of the gate driver on array circuit shown in FIG. 1.

Please refer to FIGS. 1 to 3. FIG. 3 is another circuit structure diagram of the gate driver on array circuit shown in FIG. 1, The GOA circuit 100 shown in FIG. 3 includes, but not limited to, the pull-up control circuit 10, the pull-up circuit 20, the pull-down circuit 30, the reset circuit 40, a first pull-down holding circuit 50 and a second pull-down holding circuit 60 as shown in FIG. 1, The specific structure of the pull-up control circuit 10, the pull-up circuit 20, the pull-down circuit 30, the reset circuit 40 and the first pull-down holding circuit 50 in the GOA circuit 100 shown in FIG. 3 is similar with the specific structure of the GOA circuit 100 shown in FIG. 2, and is not repeated here.

As shown in FIG. 3, in another embodiment of the present invention, the second pull-down holding circuit 60 specifically includes: a fourteenth thin film transistor T51, a fifteenth thin film transistor T52, a sixteenth thin film transistor T53, a seventeenth thin film transistor T54, an eighteenth thin film transistor T42, a nineteenth thin film transistor T32-1, a twentieth thin film transistor T32-2, a twenty-first thin film transistor T32-3 and a twenty-second thin film transistor T42-1. The connection manner and signal input of the fourteenth thin film transistor T51, the fifteenth thin film transistor T52, the sixteenth thin film transistor T53, the seventeenth thin film transistor T54, the nineteenth thin film transistor T32-1, the twentieth thin film transistor T32-2 and the twenty-first thin film transistor T32-3 in the second pull-down holding circuit 60 shown in FIG. 3 are the same as those of the corresponding thin film transistors in the second pull-down holding circuit 60 shown in FIG. 2, and are not repeated here. A control end of the eighteenth thin film transistor T42 is electrically connected to the second signal point Pn, and a first end and a second end of the eighteenth thin film transistor are electrically connected to the pull-up control signal point Qn; a control end and a first end of the twenty-second thin film transistor T42-1 are electrically connected to the pull-up control signal point Qn, and a second end of the twenty-second thin film transistor is inputted with the first direct current low voltage signal VSSQ1: the eighteenth thin film transistor T42 and the twenty-second thin film transistor T42-1 are configured to hold the pull-up control signal Q(n) in the off state according to the direct current high voltage signal VGH and the first direct current low voltage signal VSSQ1, and the twenty-second thin film transistor T42-1 can prevent the current of the eighteenth thin film transistor T42 from flowing into the first direct current low voltage signal VSSQ1, thereby improving the reliability of the GOA circuit 100.

Figure 4:
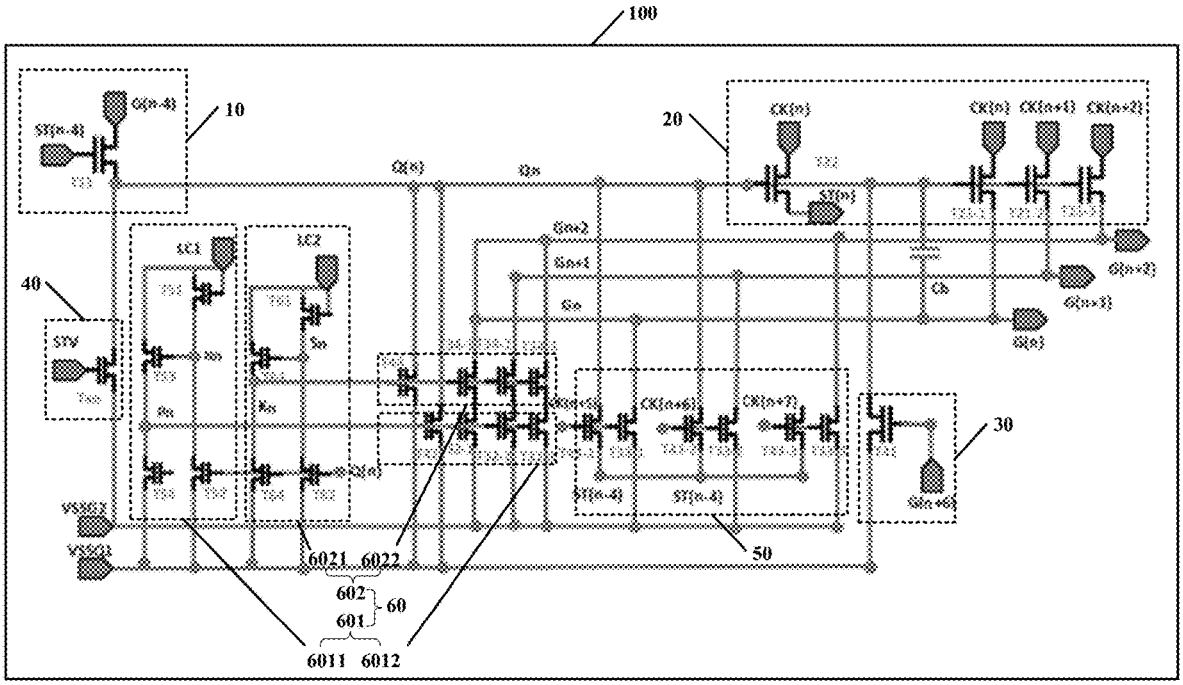
FIG. 4 is one another circuit structure diagram of the gate driver on array circuit shown in FIG. 1.

Please refer to FIG. 1, FIG. 2 and FIG. 4. FIG. 4 is one another circuit structure diagram of the gate driver on array circuit shown in FIG. 1. The GOA circuit 100 shown in FIG. 4 includes, but not limited to, the pull-up control circuit 10, the pull-up circuit 20, the pull-down circuit 30, the reset circuit 40, a first pull-down holding circuit 50 and a second pull-down holding circuit 60 as shown in FIG. 1. The specific structure of the pull-up control circuit 10, the pull-up circuit 20, the pull-down circuit 30, the reset circuit 40 and the first pull-down holding circuit 50 in the GOA circuit 100 shown in FIG. 4 is similar with the specific structure of the GOA circuit 100 shown in FIG. 2, and is not repeated here.

As shown in FIG. 4, in another embodiment of the present invention, the pull-down holding signal PDH includes a first low-frequency signal LC1 and a second low-frequency signal LC2, and the second pull-down holding circuit 60 includes a first pull-down holding module 601 and a second pull-down holding module 602.

The first pull-down holding module 601 specifically includes: a first signal inputting unit 6011 and a first pull-down holding unit 6012. The first signal inputting unit 6011 specifically includes a fourteenth thin film transistor T51, a fifteenth thin film transistor T52, a sixteenth thin film transistor T53 and a seventeenth thin film transistor T54. The first pull-down holding unit 6012 specifically includes: an eighteenth thin film transistor T42, a nineteenth thin film transistor T32-1, a twentieth thin film transistor T32-2 and a twenty-first thin film transistor T32-3. The connection manner and signal input of the fifteenth thin film transistor T52, the seventeenth thin film transistor T54, the eighteenth thin film transistor T42, the nineteenth thin film transistor T32-1, the twentieth thin film transistor T32-2 and the twenty-first thin film transistor T32-3 in the second pull-down holding circuit 60 shown in FIG. 4 are the same as those of the corresponding thin film transistors in the second pull-down holding circuit 60 shown in FIG. 2, and are not repeated here. A control end and a first end of the fourteenth thin film transistor T51 are inputted with a first low frequency signal LC1, and a second end of the fourteenth thin film transistor is electrically connected to a first signal point Nn; a control end of the sixteenth thin film transistor T53 is electrically connected to the first signal point Nn, and a first end of the sixteenth thin film transistor is inputted with the first low frequency signal LC1, and a second end of the sixteenth thin film transistor is electrically connected to a second signal point Pn.

The second pull-down holding module 602 specifically includes; a second signal inputting unit 6021 and a second pull-down holding unit 6022. The second signal inputting unit 6021 specifically includes a second thirteen thin film transistor T61, a twenty fourth thin film transistor T62, a twenty fifth thin film transistor T63 and a twenty sixth thin film transistor T64. The second pull-down holding unit 6022 specifically includes: a twenty-seventh thin film transistor T44, a twenty-eighth thin film transistor T34-1, a twenty-ninth thin film transistor T34-2 and a thirtieth thin film transistor T34-3. A control end and a first end of the twenty-third thin film transistor T61 are inputted with the second low frequency signal LC2, and a second end of the twenty-third thin film transistor is electrically connected to a third signal point Sn; a control end of the twenty-fourth thin film transistor T62 is electrically connected to the pull-up control signal point Qn, a first end of the twenty-fourth thin film transistor is electrically connected to the third signal point Sn, and a second end of the twenty-fourth thin film transistor is input to the first direct current low voltage signal VSSQ1; a control end of the twenty-fifth thin film transistor T63 is electrically connected to the third signal point Sn, and a first end of the twenty-fifth thin film transistor is inputted with the second low frequency signal LC2, and a second end of the twenty-fifth thin film transistor is electrically connected to a fourth signal point Kn; a control end of the twenty-sixth thin film transistor T64 is electrically connected to the pull-up control signal point Qn, and a first end of the twenty-sixth thin film transistor is electrically connected to the fourth signal point Kn, and a second end of the twenty-sixth thin film transistor is inputted with the first direct current low voltage signal VSSQ1; a control end of the twenty-seventh thin film transistor T44 is electrically connected to the fourth signal point Kn, and a first end of the twenty-seventh thin film transistor is electrically connected to the pull-up control signal point Qn, and a second end of the twenty-seventh thin film transistor is inputted with the first direct current low voltage signal VSSQ1, and the twenty-seventh thin film transistor T44 holds the pull-up control signal Q(n) in the off state according to the second low frequency signal LC2 and the first direct current low voltage signal VSSQ1; a control end of the twenty-eighth thin film transistor T34-1 is electrically connected to the fourth signal point Kn, and a first end of the twenty-eighth thin film transistor is electrically connected to the nth stage horizontal scanning line Gn, and a second end of the twenty-eighth thin film transistor is inputted with the second direct current low voltage signal VSSG2, and the twenty-eighth thin film transistor T34-1 holds the nth stage scan driving signal G(n) in the off state according to the second low frequency signal LC2 and the second direct current low voltage signal VSSG2; a control end of the twenty-ninth thin film transistor T34-2 is electrically connected to the fourth signal point Kn, and a first end of the twenty-ninth thin film transistor is electrically connected to the n+1th stage horizontal scanning line Gn+1, and a second end of the twenty-ninth thin film transistor is inputted with the second direct current low voltage signal VSSG2, and the twenty-ninth thin film transistor T34-2 holds the n+1th stage scan driving signal G(n+1) according to the second low frequency signal LC2 and the second direct current low voltage signal VSSG2; a control end of the thirtieth thin film transistor T34-3 is electrically connected to the fourth signal point Kn, and a first end of the thirtieth thin film transistor is electrically connected to the n+2th stage horizontal scanning line Gn+2, and a second end of the thirtieth thin film transistor is inputted with the second direct current low voltage signal VSSG2, and the thirtieth thin film transistor T34-3 holds the n+2th stage scan driving signal G(n+2) according to the fourth signal point Kn and the second direct current low voltage signal VSSG2.

The first low frequency signal LC1 and the second low frequency signal LC2 are mutually inverted signals, that is, when the first low frequency signal LC1 is in a high potential state, the second low frequency signal LC2 is in a low potential state: and when the first low frequency signal LC1 is in a low potential state, the second low frequency signal LC2 is in a high potential state. The first pull-down holding module 601 and the second pull-down holding module 602 alternately function to hold the pull-up control signal Q(n), the nth stage scan driving signal G(n), the n+1th stage scan driving signal G(n+1) and the n+2th stage scan driving signal G(n+2) in the off state (i.e. low potential state).

Figure 5:
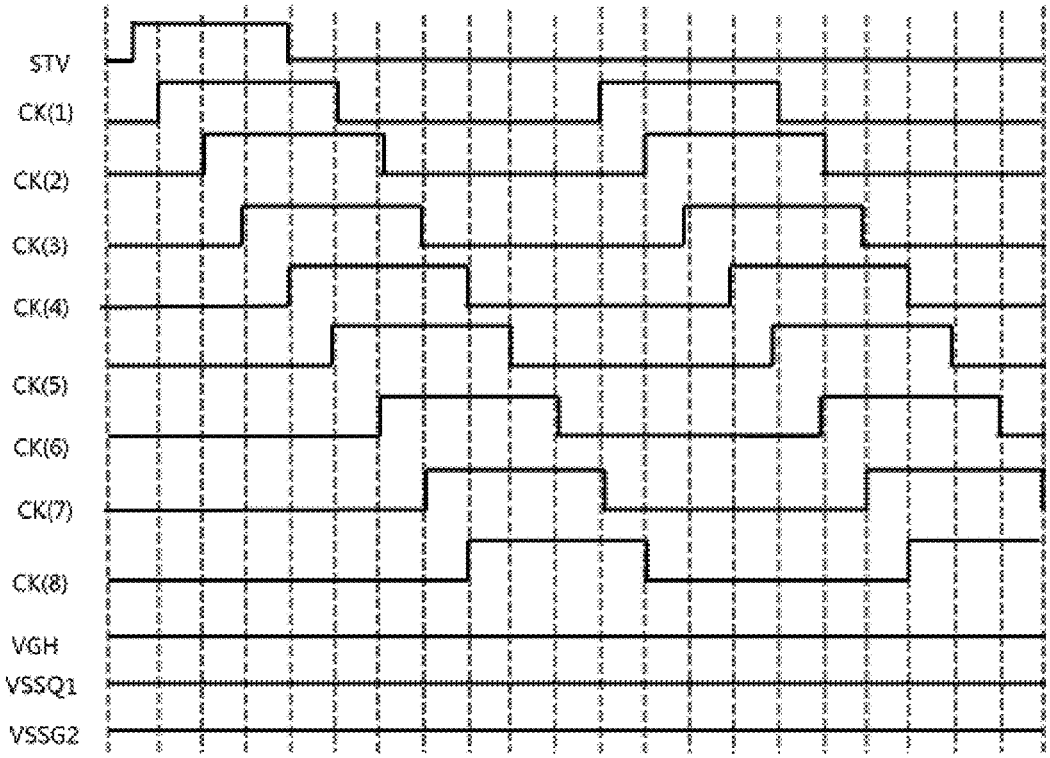
FIG. 5 is a waveform diagram of signal sources in the gate driver on array circuit shown in FIGS. 2 and 3.

Please refer to FIG. 2, FIG. 3 and FIG. 5. FIG. 5 is a waveform diagram of signal sources in the GOA circuit 100 shown in FIGS. 2 and 3. The signal sources include, but are not limited to, the initial signal STV, the nth stage clock signal CK(n), the direct current high voltage signal VGH, the first direct current low voltage signal VSSQ1, and the second direct current low voltage signal VSSG2.

Figure 6:
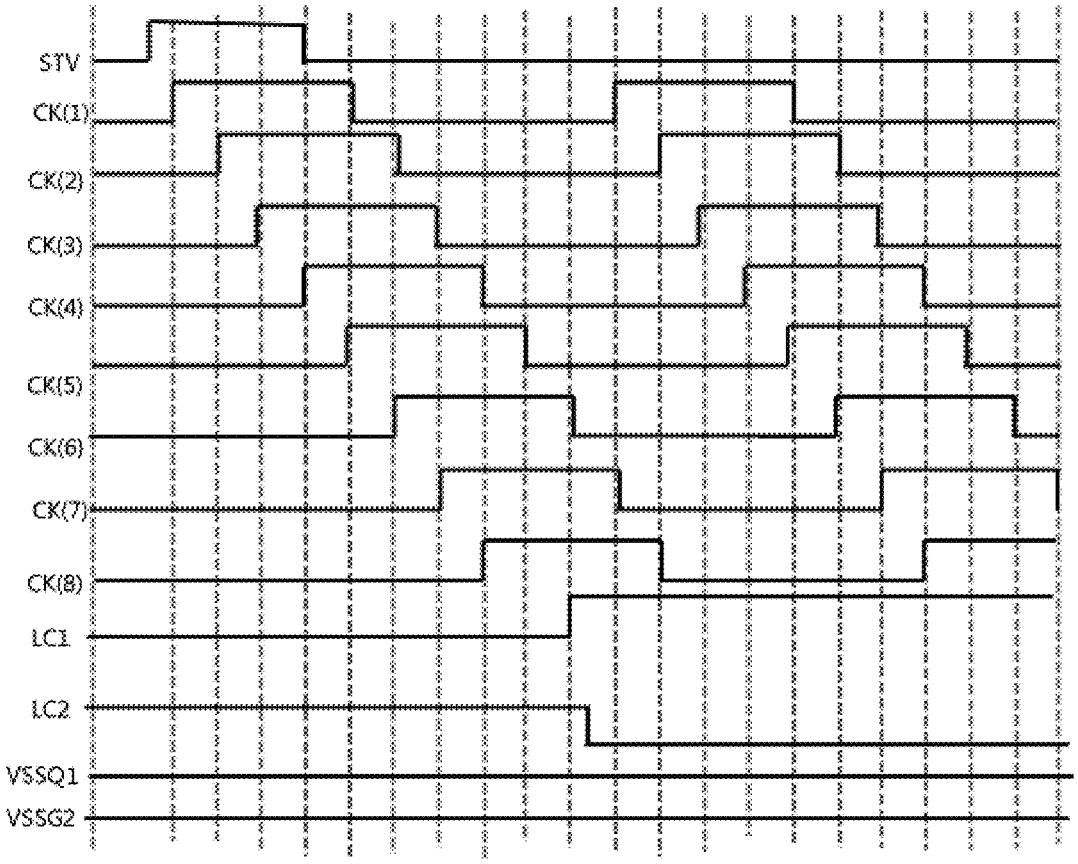
FIG. 6 is a waveform diagram of signal sources in the gate driver on array circuit shown in FIG. 4.

Please refer to FIG. 4 and FIG. 6. FIG. 6 is a waveform diagram of signal sources in the GOA circuit 100 shown in FIG. 4. The signal sources include, but are not limited to, the initial signal STV, the nth stage clock signal CK(n), the first low frequency signal LC1, the second low frequency signal LC2, the first direct current low voltage signal VSSQ1, and the second direct current low voltage signal VSSG2.

As shown in FIG. 5 and FIG. 6, the periods of the clock signals of the respective stages are the same, and the start time of the n+1th stage clock signal CK(n+1) is 1/10 clock signal period later than the nth stage clock signal CK(n). FIG. 5 and FIG. 6 show only waveform diagrams of the first stage clock signal CK(1) to the eighth stage clock signal CK(8).

As shown in FIG. 5 and FIG. 6, in one embodiment of the present invention, the duty ratio of the nth stage clock signal CK(n) is set to 40%, which is advantageous for the pull-down of the nth stage scan driving signal G(n).

Figure 7:
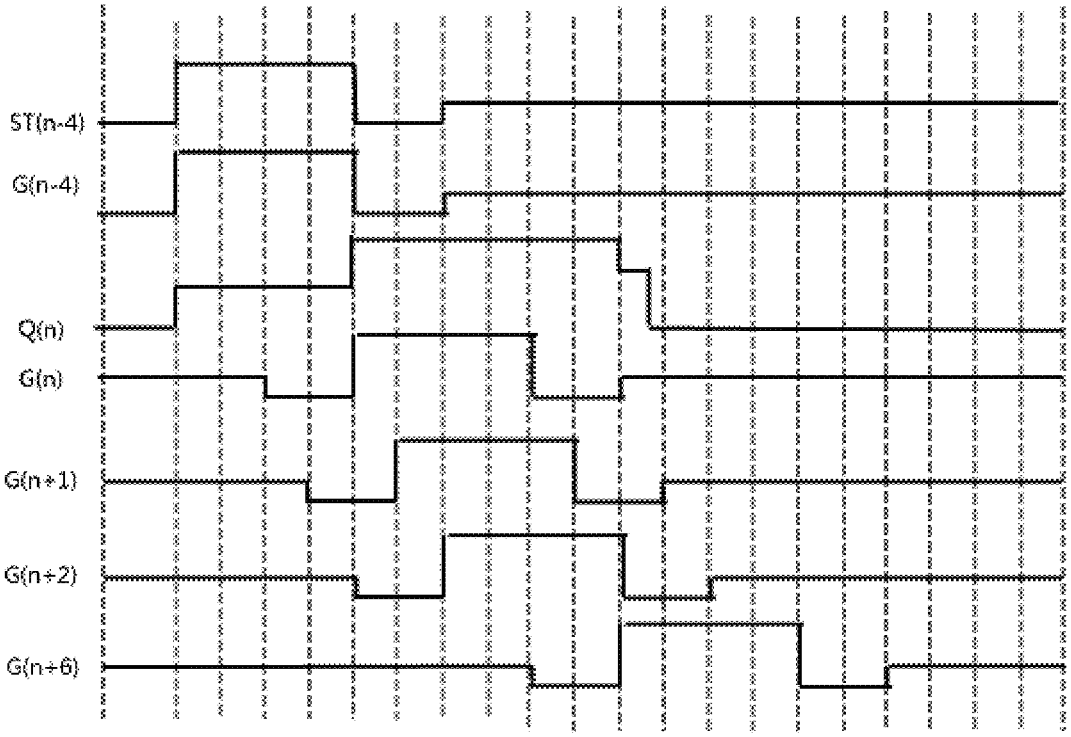
FIG. 7 is a waveform diagram of input and output signals in the gate driver on array circuit shown in FIGS. 1 to 4.

Please refer to FIG. 1, FIG. 2, FIG. 3, FIG. 4 and FIG. 7. FIG. 7 is a waveform diagram of input and output signals in the GOA circuit 100 shown in FIGS. 1 to 4. The input and output signals include but are not limited to: the n−4th stage transfer signal ST(n−4), the n−4th stage scan driving signal G(n−4), the pull up control signal Q(n), the nth stage scan driving signal G(n), the n+1th stage scan driving signal G(n+1), the n+2th stage scan driving signal G(n+2) and n+6th stage scan driving signal G(n+6).

As shown in FIG. 7, the pull-down circuit 30 pulls down the pull-up control signal Q(n) according to the n+6th stage scan driving signal G(n+6), and can achieve pulling down the pull-up control signal Q(n) after accomplishing the output of the nth stage scan driving signal G(n), the n+1th stage scan driving signal G(n+1) and the n+2th stage scan driving signal G(n+2), thereby realizing the normal output of the nth stage scan driving signal G(n), the n+1th stage scan driving signal G(n+1) and the n+2th stage scan driving signal G(n+2).

Correspondingly, the embodiment of the present invention further provides a liquid crystal display device, including the GOA circuits 100 in FIGS. 1 to 4 applied for liquid crystal display. For example, the liquid crystal display device may include, but not limited to a mobile phone with a liquid crystal display panel (such as an Android mobile phone, an iOS mobile phone, etc.), a tablet computer, a mobile internet device (MID), a personal digital assistant (PDA), a laptop, a TV set, an electronic paper, a digital photo frame and etc.

Compared with the prior art, in which one stage GOA unit can only output one stage scan driving signal, one stage GOA unit of the GOA circuit 100 in the embodiment of the present invention can output three stages scan driving signals. Namely, the nth stage GOA unit can output the nth stage scan driving signal G(n), the n+1th stage scan driving signal G(n+1) and the n+2th stage scan driving signal G(n+2). The average frame space occupied by each stage of the GOA unit of the GOA circuit 100 can be reduced, thereby meeting the ultra-narrow frame requirement of the liquid crystal display panel. Furthermore, the arrangement of the first direct current low voltage signal VSSQ1 and the reset circuit 40 in the embodiment of the present invention can improve the reliability of the GOA circuit 100.

In the description of the present specification, the reference terms, "one embodiment", "some embodiments", "an illustrative embodiment", "an example", "a specific example", or "some examples" mean that such description combined with the specific features of the described embodiments or examples, structure, material, or characteristic is included in the utility model of at least one embodiment or example. In the present specification, the terms of the above schematic representation do not certainly refer to the same embodiment or example. Meanwhile, the particular features, structures, materials, or characteristics which are described may be combined in a suitable manner in any one or more embodiments or examples.

The detail description has been introduced above for the gate driver on array circuit and the liquid crystal display device having the gate driver on array circuit, which are provided by the embodiment of the invention. Herein, a specific case is applied in this article for explain the principles and specific embodiments of the present invention have been set forth. The description of the aforesaid embodiments is only used to help understand the method of the present invention and the core idea thereof; meanwhile, for those of ordinary skill in the art, according to the idea of the present invention, there should be changes either in the specific embodiments and applications but in sum, the contents of the specification should not be limitation to the present invention.

What is claimed is:

1. A gate driver on array circuit, comprising a plurality of gate driver on array units, which are cascade coupled, wherein an nth stage gate driver on array unit charges an nth stage horizontal scanning line, an n+1th stage horizontal scanning line and an n+2th stage horizontal scanning line of a display area of a panel, and the nth stage gate driver on array unit comprises a pull-up control circuit, a pull-up circuit and a pull-down circuit, wherein n is a positive integer;

the pull-up control circuit receives a start signal CT, and outputs a pull-up control signal Q(n) according to the start signal CT;

the pull-up circuit is electrically connected to the pull-up control circuit to receive the pull-up control signal Q(n), an nth stage clock signal CK(n), an n+1th stage clock signal CK(n+1) and an n+2th stage clock signal CK(n+2), and to output an nth stage transfer signal ST(n), an nth stage scan driving signal G(n), an n+1th stage scan driving signal G(n+1), and an n+2th stage scan driving signal G(n+2) according to the pull-up control signal Q(n), the nth stage clock signal CK(n), the n+1th stage clock signal CK(n+1) and the n+2th stage clock signal CK(n+2);

the pull-down circuit is electrically connected to the pull-up control circuit and the pull-up circuit to receive an n+6th stage scan driving signal G(n+6) outputted by an n+6th stage gate driver on array unit and a first direct current low voltage signal VSSQ1, and to pull down the pull-up control signal Q(n) according to the n+6th stage scan driving signal G(n+6) and the first direct current low voltage signal VSSQ1 to enable the pull-up control signal Q(n) in an off state, wherein the nth stage gate driver on array unit further comprises a reset circuit, a first pull-down holding circuit, and a second pull-down holding circuit;

the reset circuit is electrically connected to the pull-up control circuit, the pull-up circuit and the pull-down circuit, and the reset circuit receives the initial signal STV and a second direct current low voltage signal VSSG2, and resets the pull-up control signal Q(n) according to the initial signal STV and the second direct current low voltage signal VSSG2;

the first pull-down holding circuit is electrically connected to the pull-up control circuit, the pull-up circuit, the pull-down circuit and the reset circuit, and the first pull-down holding circuit receives an n+5th stage clock signal CK(n+5), an n+6th stage clock signal CK(n+6), an n+7th stage clock signal CK(n+7), the n−4th stage transfer signal ST(n−4) and the second direct current low voltage signal VSSG2, and to enable the pull-up control signal Q(n), the nth stage scan driving signal G(n), the n+1th stage scan driving signal G(n+1) and the n+2th stage scan driving signal G(n+2) in the off state according to the n+5th stage clock signal CK(n+5), the n+6th stage clock signal CK(n+6), the n+7th stage clock signal CK(n+7), the n−4th stage transfer signal ST(n−4) and the second direct current low voltage signal VSSG2;

the second pull-down holding circuit is electrically connected to the pull-up control circuit, the pull-up circuit, the pull-down circuit, the reset circuit and the first pull-down holding circuit, and the second pull-down holding circuit receives a pull-down holding signal PDH, the first direct current low-voltage signal VSSQ1 and the second direct current low-voltage signal VSSG2 to enable the pull-up control signal Q(n), the nth scan driving signal G(n), the n+1th scan driving signal G(n+1) and the n+2th stage scan driving signal G(n+2) in the off state according to the pull-down holding signal PDH, the first direct current low-voltage signal VSSQ1 and the second direct current low-voltage signal VSSG2.

2. The gate driver on array circuit according to claim 1, wherein when n is greater than or equal to 1 and less than or equal to 4, the start signal CT is an initial signal STV, and the pull-up control circuit outputs the pull-up control signal Q(n) according to the initial signal STV; when n is greater than 4, the start signal CT is an n−4th stage transfer signal ST(n−4) and an n−4th stage scan driving signal G(n−4) output by the n−4th stage gate driver on array unit, and the pull-up control circuit outputs the pull-up control signal Q(n) according to the n−4th stage transfer signal ST(n−4) and the n−4th stage scan driving signal G(n−4).

3. The gate driver on array circuit according to claim 2, wherein the pull-up control circuit comprises: a first thin film transistor (T11); wherein when n is greater than or equal to 1 and less than or equal to 4, a control end and a first end of the first thin film transistor (T11) are inputted with the initial signal STV, and a second end of the first thin film transistor is connected to a pull-up control signal point Qn to output the pull-up control signal Q(n) according to the initial signal STV; when n is greater than 4, the control end of the first thin film transistor (T11) is inputted with the n−4th stage transfer signal ST(n−4), and the first end of the first thin film transistor is inputted with the n−4th stage scan driving signal G(n−4), and the second end of the first thin film transistor is connected to the pull-up control signal point Qn to output the pull-up control signal Q(n) according to the n−4th stage transfer signal ST(n−4) and the n−4th stage scan driving signal G(n−4);

the pull-up circuit comprises: a second thin film transistor (T22), a third thin film transistor (T21-1), a fourth thin film transistor (T21-2) and a fifth thin film transistor (T21-3); a control end of the second thin film transistor (T22) is electrically connected to the pull-up control signal point Qn to receive the pull-up control signal Q(n), and a first end of the second thin film transistor is inputted with the nth stage clock signal CK(n), and a second end of the second thin film transistor outputs the nth stage transfer signal ST(n) according to the pull-up control signal Q(n) and the nth stage clock signal CK(n); a control end of the third thin film transistor (T21-1) is electrically connected to the pull-up control signal point Qn to receive the pull-up control signal Q(n), and a first end of the third thin film transistor is inputted with the nth stage clock signal CK(n), and a second end of the third thin film transistor is electrically connected to the nth stage horizontal scanning line Gn to output the nth stage scan driving signal G(n) according to the pull-up control signal Q(n) and the nth stage clock a signal CK(n); a control end of the fourth thin film transistor (T21-2) is electrically connected to the pull-up control signal point Qn to receive the pull-up control signal Q(n), and a first end of the fourth thin film transistor is inputted with the n+1th stage clock signal CK(n+1), and a second end of the fourth thin film transistor is electrically connected to the n+1th stage scan driving signal line Gn+1 to output the n+1th stage scan driving signal G(n+1) according to the pull-up control signal Q(n) and the n+1th stage clock signal CK(n+1); a control end of the fifth thin film transistor (T21-3) is electrically connected to the pull-up control signal point Qn to receive the pull-up control signal Q(n), and a first end of the fifth thin film transistor is inputted with the n+2th stage clock signal CK(n+2), and a second end of the fifth thin film transistor is electrically connected to the n+2th stage horizontal scanning line Gn+2 to output the n+2th stage scan driving signal G(n+2) according to the pull-up control signal Q(n) and the n+2th stage clock signal CK(n+2);

the pull-down circuit comprises: a sixth thin film transistor (T41), and a control end of the sixth thin film transistor is inputted with an n+6th stage scan driving signal G(n+6), and a first end of the sixth thin film transistor is electrically connected to the pull-up control signal point Qn, and a second end of the sixth thin film transistor is inputted with the first direct current low voltage signal VSSQ1, and the sixth thin film transistor (T41) pulls down the pull-up control signal Q(n) according to the n+6th stage scan driving signal G(n+6) and the first direct current low voltage signal VSSQ1 to enable the pull-up control signal Q(n) in the off state.

4. The gate driver on array circuit according to claim 1, wherein the reset circuit comprises: a seventh thin film transistor Txo, and a control end is inputted with the initial signal STV, and a first end of the seventh thin film transistor is electrically connected to the pull-up control signal point Qn, and a second end of the seventh thin film transistor is inputted with the second direct current low voltage signal VSSG2 to reset a potential of the pull-up control signal point Qn according to the initial signal STV and the second direct current low voltage signal VSSG2 after the gate driver on array circuit operates for one cycle;

the first pull-down holding circuit comprises: an eighth thin film transistor (T43-1), a ninth thin film transistor (T33-1), a tenth thin film transistor (T43-2), an eleventh thin film transistor (T33-2), a twelfth thin film transistor (T43-3) and a thirteenth thin film transistor (T33-3); a control end of the eighth thin film transistor (T43-1) is inputted with the n+5th stage clock signal CK(n+5), and a first end of the eighth thin film transistor is electrically connected to the pull-up control signal point Qn, and a second end of the eighth thin film transistor is inputted with the n−4th stage transfer signal ST(n−4), and the eighth thin film transistor (T43-1) to hold the pull-up control signal Q(n) in the off state according to the n+5th stage clock signal CK(n+5) and the n−4th stage transfer signal ST(n−4); a control end of the ninth thin film transistor (T33-1) is inputted with the n+5th stage clock signal CK(n+5), and a first end of the ninth thin film transistor is electrically connected to the nth stage horizontal scanning line Gn, and a second end of the ninth thin film transistor is inputted with the first direct current low voltage signal VSSQ1, and the ninth thin film transistor (T33-1) holds the nth stage scan driving signal G(n) in the off state according to the n+5th stage clock signal CK(n+5) and the first direct current low voltage signal VSSQ1; a control end of the tenth thin film transistor (T43-2) inputs an n+6th stage clock signal CK(n+6), and a first end of the tenth thin film transistor is electrically connected to the pull-up control signal point Qn, and a second of the tenth thin film transistor is inputted with the n−4th stage transfer signal ST(n−4), and the tenth thin film transistor (T43-2) holds the pull-up control signal Q(n) in the off state according to the n+6th stage clock signal CK(n+6) and the n−4th stage transfer signal ST(n−4); a control end of the eleventh thin film transistor (T33-3) is inputted with the n+6th stage clock signal CK(n+6), and a first end of the eleventh thin film transistor is electrically connected to the n+1th stage horizontal scanning line Gn+1, and a second end of the eleventh thin film transistor is inputted with the first direct current low voltage signal VSSQ1, and the eleventh thin film transistor (T33-3) holds the n+1th stage scan drive signal G(n+1) in the off state according to the n+6th stage clock signal CK(n+6) and the first direct current low voltage signal VSSQ1; a control end of the twelfth thin film transistor (T43-3) is inputted with the n+7th stage clock signal CK(n+7), and a first end of the twelfth thin film transistor is electrically connected to the pull-up control signal point Qn, and a second end of the twelfth thin film transistor is inputted with the n−4th stage transfer signal ST(n−4), and the twelfth thin film transistor (T43-3) holds the pull-up control signal Q(n) in the off state according to the n+7th stage clock signal CK(n+7) and the n−4th stage transfer signal ST(n−4); a control end of the thirteenth thin film transistor (T33-3) is inputted with the n+7th stage clock signal CK(n+7), a first end of the thirteenth thin film transistor is electrically connected to the n+2th stage horizontal scanning line Gn+2, a second end of the thirteenth thin film transistor is inputted with the first direct current low voltage signal VSSQ1, and the thirteenth thin film transistor (T33-3) holds the n+2th stage scan drive signal G(n+2) in the off state according to the n+7th stage clock signal CK(n+7) and the first direct current low voltage signal VSSQ1.

5. The gate driver on array circuit according to claim 4, wherein the pull-down holding signal PDH is a direct current high voltage signal VGH;

the second pull-down holding circuit comprises: a fourteenth thin film transistor (T51), a fifteenth thin film transistor (T52), a sixteenth thin film transistor (T53), a seventeenth thin film transistor (T54), an eighteenth thin film transistor (T42), a nineteenth thin film transistor (T32-1), a twentieth thin film transistor (T32-2) and a twenty-first thin film transistor (T32-3); a control end and a first end of the fourteenth thin film transistor (T51) are inputted with the direct current high voltage signal VGH, and a second end of the fourteenth thin film transistor is electrically connected to a first signal point Nn; a control end of the fifteenth thin film transistor (T52) is electrically connected to the pull-up control signal point Qn, and a first end of the fifteenth thin film transistor is electrically connected to the first signal point Nn, and a second end of the fifteenth thin film transistor is inputted with the first direct current low voltage signal VSSQ1; a control end of the sixteenth thin film transistor (T53) is electrically connected to the first signal point Nn, and a first end of the sixteenth thin film transistor is inputted with the direct current high voltage signal VGH, and a second end of the sixteenth thin film transistor is electrically connected to a second signal point Pn, and a control end of the seventeenth thin film transistor (T54) is electrically connected to the pull-up control signal point Qn, and a first end of the seventeenth thin film transistor is electrically connected to the second signal point Pn, and a second end of the seventeenth thin film transistor is inputted with the first direct current low voltage signal VSSQ1; a control end of the eighteenth thin film transistor (T42) is electrically connected to the second signal point Pn, and a first end of the eighteenth thin film transistor is electrically connected to the pull-up control signal point Qn, and a second end of the eighteenth thin film transistor is inputted with the first direct current low voltage signal VSSQ1, and the eighteenth thin film transistor (T42) holds the pull-up control signal Q(n) in the off state according to the direct current high voltage signal VGH and the first direct current low voltage signal VSSQ1; a control end of the nineteenth thin film transistor (T32-1) is electrically connected to the second signal point Pn, and a first end of the nineteenth thin film transistor is electrically connected to the nth stage horizontal scanning line Gn, and a second end of the nineteenth thin film transistor is inputted with the second direct current low voltage signal VSSG2, and the nineteenth thin film transistor (T32-1) holds the nth stage scan driving signal G(n) in the off state according to the direct current high voltage signal VGH and the second direct current low voltage signal VSSG2; a control end of the twentieth thin film transistor (T32-2) is electrically connected to the second signal point Pn, and a first end of the twentieth thin film transistor is electrically connected to the n+1th stage horizontal scanning line Gn+1, and a second end of the twentieth thin film transistor is inputted with the second direct current low voltage signal VSSG2, and the twentieth thin film transistor (T32-2) holds the n+1th stage scan driving signal G(n+1) in the off state according to the direct current high voltage signal VGH and the second direct current low voltage signal VSSG2; a control end of the twenty-first thin film transistor (T32-3) is electrically connected to the second signal point Pn, and a first end of the twenty-first thin film transistor is electrically connected to the n+2th stage horizontal scanning line Gn+2, and a second end of the twenty-first thin film transistor is inputted with the second direct current low voltage signal VSSG2, and the twenty-first thin film transistor (T32-3) holds the n+2th stage scan driving signal G(n+2) in the off state according to the direct current high voltage signal VGH and the second direct current low voltage signal VSSG2.

6. The gate driver on array circuit according to claim 4, wherein the pull-down holding signal PDH is a direct current high voltage signal VGH;

the second pull-down holding circuit comprises: a fourteenth thin film transistor (T51), a fifteenth thin film transistor (T52), a sixteenth thin film transistor (T53), a seventeenth thin film transistor (T54), an eighteenth thin film transistor (T42), a nineteenth thin film transistor (T32-1), a twentieth thin film transistor (T32-2), a twenty-first thin film transistor (T32-3) and a twenty-second thin film transistor (T42-1); a control end and a first end of the fourteenth thin film transistor (T51) are inputted with the direct current high voltage signal VGH, and a second end of the fourteenth thin film transistor is electrically connected to a first signal point Nn; a control end of the fifteenth thin film transistor (T52) is electrically connected to the pull-up control signal point Qn, and a first end of the fifteenth thin film transistor is electrically connected to the first signal point Nn, and a second end of the fifteenth thin film transistor is inputted with the first direct current low voltage signal VSSQ1; a control end of the sixteenth thin film transistor (T53) is electrically connected to the first signal point Nn, and a first end of the sixteenth thin film transistor is inputted with the direct current high voltage signal VGH, and a second end of the sixteenth thin film transistor is electrically connected to a second signal point Pn, and a control end of the seventeenth thin film transistor (T54) is electrically connected to the pull-up control signal point Qn, and a first end of the seventeenth thin film transistor is electrically connected to the second signal point Pn, and a second end of the seventeenth thin film transistor is inputted with the first direct current low voltage signal VSSQ1; a control end of the eighteenth thin film transistor (T42) is electrically connected to the second signal point Pn, and a first end and a second end of the eighteenth thin film transistor are electrically connected to the pull-up control signal point Qn; a control end and a first end of the twenty-second thin film transistor (T42-1) are electrically connected to the pull-up control signal point Qn, and a second end of the twenty-second thin film transistor is inputted with the first direct current low voltage signal VSSQ1, and the eighteenth thin film transistor (T42) and the twenty-second thin film transistor (T42-1) hold the pull-up control signal Q(n) in the off state according to the direct current high voltage signal VGH and the first direct current low voltage signal VSSQ1; a control end of the nineteenth thin film transistor (T32-1) is electrically connected to the second signal point Pn, and a first end of the nineteenth thin film transistor is electrically connected to the nth stage horizontal scanning line Gn, and a second end of the nineteenth thin film transistor is inputted with the second direct current low voltage signal VSSG2, and the nineteenth thin film transistor (T32-1) holds the nth stage scan driving signal G(n) in the off state according to the direct current high voltage signal VGH and the second direct current low voltage signal VSSG2; a control end of the twentieth thin film transistor (T32-2) is electrically connected to the second signal point Pn, and a first end of the twentieth thin film transistor is electrically connected to the n+1th stage horizontal scanning line Gn+1, and a second end of the twentieth thin film transistor is inputted with the second direct current low voltage signal VSSG2, and the twentieth thin film transistor (T32-2) holds the n+1th stage scan driving signal G(n+1) in the off state according to the direct current high voltage signal VGH and the second direct current low voltage signal VSSG2; a control end of the twenty-first thin film transistor (T32-3) is electrically connected to the second signal point Pn, and a first end of the twenty-first thin film transistor is electrically connected to the n+2th stage horizontal scanning line Gn+2, and a second end of the twenty-first thin film transistor is inputted with the second direct current low voltage signal VSSG2, and the twenty-first thin film transistor (T32-3) holds the n+2th stage scan driving signal G(n+2) in the off state according to the direct current high voltage signal VGH and the second direct current low voltage signal VSSG2.

7. The gate driver on array circuit according to claim 4, wherein the pull-down holding signal PDH comprises a first low-frequency signal LC1 and a second low-frequency signal LC2, and the second pull-down holding circuit comprises a first pull-down holding module and a second pull-down holding module;

the first pull-down holding circuit comprises: a fourteenth thin film transistor (T51), a fifteenth thin film transistor (T52), a sixteenth thin film transistor (T53), a seventeenth thin film transistor (T54), an eighteenth thin film transistor (T42), a nineteenth thin film transistor (T32-1), a twentieth thin film transistor (T32-2) and a twenty-first thin film transistor (T32-3); a control end and a first end of the fourteenth thin film transistor (T51) are inputted with the first low frequency signal LC1, and a second end of the fourteenth thin film transistor is electrically connected to a first signal point Nn; a control end of the fifteenth thin film transistor (T52) is electrically connected to the pull-up control signal point Qn, and a first end of the fifteenth thin film transistor is electrically connected to the first signal point Nn, and a second end of the fifteenth thin film transistor is inputted with the first direct current low voltage signal VSSQ1; a control end of the sixteenth thin film transistor (T53) is electrically connected to the first signal point Nn, and a first end of the sixteenth thin film transistor is inputted with the first low frequency signal LC1, and a second end of the sixteenth thin film transistor is electrically connected to a second signal point Pn, and a control end of the seventeenth thin film transistor (T54) is electrically connected to the pull-up control signal point Qn, and a first end of the seventeenth thin film transistor is electrically connected to the second signal point Pn, and a second end of the seventeenth thin film transistor is inputted with the first direct current low voltage signal VSSQ1; a control end of the eighteenth thin film transistor (T42) is electrically connected to the second signal point Pn, and a first end of the eighteenth thin film transistor is electrically connected to the pull-up control signal point Qn, and a second end of the eighteenth thin film transistor is inputted with the first direct current low voltage signal VSSQ1, and the eighteenth thin film transistor (T42) holds the pull-up control signal Q(n) in the off state according to the direct current high voltage signal VGH and the first direct current low voltage signal VSSQ1; a control end of the nineteenth thin film transistor (T32-1) is electrically connected to the second signal point Pn, and a first end of the nineteenth thin film transistor is electrically connected to the nth stage horizontal scanning line Gn, and a second end of the nineteenth thin film transistor is inputted with the second direct current low voltage signal VSSG2, and the nineteenth thin film transistor (T32-1) holds the nth stage scan driving signal G(n) in the off state according to the direct current high voltage signal VGH and the second direct current low voltage signal VSSG2; a control end of the twentieth thin film transistor (T32-2) is electrically connected to the second signal point Pn, and a first end of the twentieth thin film transistor is electrically connected to the n+1th stage horizontal scanning line Gn+1, and a second end of the twentieth thin film transistor is inputted with the second direct current low voltage signal VSSG2, and the twentieth thin film transistor (T32-2) holds the n+1th stage scan driving signal G(n+1) in the off state according to the direct current high voltage signal VGH and the second direct current low voltage signal VSSG2; a control end of the twenty-first thin film transistor (T32-3) is electrically connected to the second signal point Pn, and a first end of the twenty-first thin film transistor is electrically connected to the n+2th stage horizontal scanning line Gn+2, and a second end of the twenty-first thin film transistor is inputted with the second direct current low voltage signal VSSG2, and the twenty-first thin film transistor (T32-3) holds the n+2th stage scan driving signal G(n+2) in the off state according to the direct current high voltage signal VGH and the second direct current low voltage signal VSSG2;

the second pull-down holding module includes: a twenty-third thin film transistor (T61), a twenty-fourth thin film transistor (T62), a twenty-fifth thin film transistor (T63), and a twenty-sixth thin film transistor (T64), a twenty-seventh thin film transistor (T44), a twenty-eighth thin film transistor (T34-1), a twenty-ninth thin film transistor (T34-2) and a thirtieth thin film transistor (T34-3); a control end and a first end of the twenty-third thin film transistor (T61) are inputted with the second low frequency signal LC2, and a second end of the twenty-third thin film transistor is electrically connected to a third signal point Sn; a control end of the twenty-fourth thin film transistor (T62) is electrically connected to the pull-up control signal point Qn, a first end of the twenty-fourth thin film transistor is electrically connected to the third signal point Sn, and a second end of the twenty-fourth thin film transistor is input to the first direct current low voltage signal VSSQ1; a control end of the twenty-fifth thin film transistor (T63) is electrically connected to the third signal point Sn, and a first end of the twenty-fifth thin film transistor is inputted with the second low frequency signal LC2, and a second end of the twenty-fifth thin film transistor is electrically connected to a fourth signal point Kn; a control end of the twenty-sixth thin film transistor (T64) is electrically connected to the pull-up control signal point Qn, and a first end of the twenty-sixth thin film transistor is electrically connected to the fourth signal point Kn, and a second end of the twenty-sixth thin film transistor is inputted with the first direct current low voltage signal VSSQ1; a control end of the twenty-seventh thin film transistor (T44) is electrically connected to the fourth signal point Kn, and a first end of the twenty-seventh thin film transistor is electrically connected to the pull-up control signal point Qn, and a second end of the twenty-seventh thin film transistor is inputted with the first direct current low voltage signal VSSQ1, and the twenty-seventh thin film transistor (T44) holds the pull-up control signal Q(n) in the off state according to the second low frequency signal LC2 and the first direct current low voltage signal VSSQ1; a control end of the twenty-eighth thin film transistor (T34-1) is electrically connected to the fourth signal point Kn, and a first end of the twenty-eighth thin film transistor is electrically connected to the nth stage horizontal scanning line Gn, and a second end of the twenty-eighth thin film transistor is inputted with the second direct current low voltage signal VSSG2, and the twenty-eighth thin film transistor (T34-1) holds the nth stage scan driving signal G(n) in the off state according to the second low frequency signal LC2 and the second direct current low voltage signal VSSG2; a control end of the twenty-ninth thin film transistor (T34-2) is electrically connected to the fourth signal point Kn, and a first end of the twenty-ninth thin film transistor is electrically connected to the n+1th stage horizontal scanning line Gn+1, and a second end of the twenty-ninth thin film transistor is inputted with the second direct current low voltage signal VSSG2, and the twenty-ninth thin film transistor (T34-2) holds the n+1th stage scan driving signal G(n+1) according to the second low frequency signal LC2 and the second direct current low voltage signal VSSG2; a control end of the thirtieth thin film transistor (T34-3) is electrically connected to the fourth signal point Kn, and a first end of the thirtieth thin film transistor is electrically connected to the n+2th stage horizontal scanning line Gn+2, and a second end of the thirtieth thin film transistor is inputted with the second direct current low voltage signal VSSG2, and the thirtieth thin film transistor (T34-3) holds the n+2th stage scan driving signal G(n+2) according to the fourth signal point Kn and the second direct current low voltage signal VSSG2.

8. The gate driver on array circuit according to claim 7, wherein the first pull-down holding module and the second pull-down holding module alternately function to hold the pull-up control signal Q(n), the nth stage scan driving signal G(n), the n+1th stage scan driving signal G(n+1) and the n+2th stage scan driving signal G(n+2) in the off state.

9. A liquid crystal display device, comprising a gate driver on array circuit, wherein the gate driver on array circuit comprises a plurality of gate driver on array units, which are cascade coupled, wherein an nth stage gate driver on array unit charges an nth stage horizontal scanning line, an n+1th stage horizontal scanning line and an n+2th stage horizontal scanning line of a display area of a panel, and the nth stage gate driver on array unit comprises a pull-up control circuit, a pull-up circuit and a pull-down circuit, wherein n is a positive integer;

the pull-up control circuit receives a start signal CT, and outputs a pull-up control signal Q(n) according to the start signal CT;

the pull-up circuit is electrically connected to the pull-up control circuit to receive the pull-up control signal Q(n), an nth stage clock signal CK(n), an n+1th stage clock signal CK(n+1) and an n+2th stage clock signal CK(n+2), and to output an nth stage transfer signal ST(n), an nth stage scan driving signal G(n), an n+1th stage scan driving signal G(n+1), and an n+2th stage scan driving signal G(n+2) according to the pull-up control signal Q(n), the nth stage clock signal CK(n), the n+1th stage clock signal CK(n+1) and the n+2th stage clock signal CK(n+2);

the pull-down circuit is electrically connected to the pull-up control circuit and the pull-up circuit to receive an n+6th stage scan driving signal G(n+6) outputted by an n+6th stage gate driver on array unit and a first direct current low voltage signal VSSQ1, and to pull down the pull-up control signal Q(n) according to the n+6th stage scan driving signal G(n+6) and the first direct current low voltage signal VSSQ1 to enable the pull-up control signal Q(n) in an off state, wherein the nth stage gate driver on array unit further comprises a reset circuit, a first pull-down holding circuit, and a second pull-down holding circuit;

the reset circuit is electrically connected to the pull-up control circuit, the pull-up circuit and the pull-down circuit, and the reset circuit receives the initial signal STV and a second direct current low voltage signal VSSG2, and resets the pull-up control signal Q(n) according to the initial signal STV and the second direct current low voltage signal VSSG2;

the first pull-down holding circuit is electrically connected to the pull-up control circuit, the pull-up circuit, the pull-down circuit and the reset circuit, and the first pull-down holding circuit receives an n+5th stage clock signal CK(n+5), an n+6th stage clock signal CK(n+6), an n+7th stage clock signal CK(n+7), the n−4th stage transfer signal ST(n−4) and the second direct current low voltage signal VSSG2, and to enable the pull-up control signal Q(n), the nth stage scan driving signal G(n), the n+1th stage scan driving signal G(n+1) and the n+2th stage scan driving signal G(n+2) in the off state according to the n+5th stage clock signal CK(n+5), the n+6th stage clock signal CK(n+6), the n+7th stage clock signal CK(n+7), the n−4th stage transfer signal ST(n−4) and the second direct current low voltage signal VSSG2;

the second pull-down holding circuit is electrically connected to the pull-up control circuit, the pull-up circuit, the pull-down circuit, the reset circuit and the first pull-down holding circuit, and the second pull-down holding circuit receives a pull-down holding signal PDH, the first direct current low-voltage signal VSSQ1 and the second direct current low-voltage signal VSSG2 to enable the pull-up control signal Q(n), the nth scan driving signal G(n), the n+1th scan driving signal G(n+1) and the n+2th stage scan driving signal G(n+2) in the off state according to the pull-down holding signal PDH, the first direct current low-voltage signal VSSQ1 and the second direct current low-voltage signal VSSG2.

10. The liquid crystal display device according to claim 9, wherein when n is greater than or equal to 1 and less than or equal to 4, the start signal CT is an initial signal STV, and the pull-up control circuit outputs the pull-up control signal Q(n) according to the initial signal STV; when n is greater than 4, the start signal CT is an n−4th stage transfer signal ST(n−4) and an n−4th stage scan driving signal G(n−4) output by the n−4th stage gate driver on array unit, and the pull-up control circuit outputs the pull-up control signal Q(n) according to the n−4th stage transfer signal ST(n−4) and the n−4th stage scan driving signal G(n−4).

11. The liquid crystal display device according to claim 10, wherein the pull-up control circuit comprises: a first thin film transistor (T11); wherein when n is greater than or equal to 1 and less than or equal to 4, a control end and a first end of the first thin film transistor (T11) are inputted with the initial signal STV, and a second end of the first thin film transistor is connected to a pull-up control signal point Qn to output the pull-up control signal Q(n) according to the initial signal STV; when n is greater than 4, the control end of the first thin film transistor (T11) is inputted with the n−4th stage transfer signal ST(n−4), and the first end of the first thin film transistor is inputted with the n−4th stage scan driving signal G(n−4), and the second end of the first thin film transistor is connected to the pull-up control signal point Qn to output the pull-up control signal Q(n) according to the n−4th stage transfer signal ST(n−4) and the n−4th stage scan driving signal G(n−4);

the pull-up circuit comprises: a second thin film transistor (T22), a third thin film transistor (T21-1), a fourth thin film transistor (T21-2) and a fifth thin film transistor (T21-3); a control end of the second thin film transistor (T22) is electrically connected to the pull-up control signal point Qn to receive the pull-up control signal Q(n), and a first end of the second thin film transistor is inputted with the nth stage clock signal CK(n), and a second end of the second thin film transistor outputs the nth stage transfer signal ST(n) according to the pull-up control signal Q(n) and the nth stage clock signal CK(n); a control end of the third thin film transistor (T21-1) is electrically connected to the pull-up control signal point Qn to receive the pull-up control signal Q(n), and a first end of the third thin film transistor is inputted with the nth stage clock signal CK(n), and a second end of the third thin film transistor is electrically connected to the nth stage horizontal scanning line Gn to output the nth stage scan driving signal G(n) according to the pull-up control signal Q(n) and the nth stage clock a signal CK(n); a control end of the fourth thin film transistor (T21-2) is electrically connected to the pull-up control signal point Qn to receive the pull-up control signal Q(n), and a first end of the fourth thin film transistor is inputted with the n+1th stage clock signal CK(n+1), and a second end of the fourth thin film transistor is electrically connected to the n+1th stage scan driving signal line Gn+1 to output the n+1th stage scan driving signal G(n+1) according to the pull-up control signal Q(n) and the n+1th stage clock signal CK(n+1); a control end of the fifth thin film transistor (T21-3) is electrically connected to the pull-up control signal point Qn to receive the pull-up control signal Q(n), and a first end of the fifth thin film transistor is inputted with the n+2th stage clock signal CK(n+2), and a second end of the fifth thin film transistor is electrically connected to the n+2th stage horizontal scanning line Gn+2 to output the n+2th stage scan driving signal G(n+2) according to the pull-up control signal Q(n) and the n+2th stage clock signal CK(n+2);

the pull-down circuit comprises: a sixth thin film transistor (T41), and a control end of the sixth thin film transistor is inputted with an n+6th stage scan driving signal G(n+6), and a first end of the sixth thin film transistor is electrically connected to the pull-up control signal point Qn, and a second end of the sixth thin film transistor is inputted with the first direct current low voltage signal VSSQ1, and the sixth thin film transistor (T41) pulls down the pull-up control signal Q(n) according to the n+6th stage scan driving signal G(n+6) and the first direct current low voltage signal VSSQ1 to enable the pull-up control signal Q(n) in the off state.

12. The liquid crystal display device according to claim 9, wherein the reset circuit comprises: a seventh thin film transistor Txo, and a control end is inputted with the initial signal STV, and a first end of the seventh thin film transistor is electrically connected to the pull-up control signal point Qn, and a second end of the seventh thin film transistor is inputted with the second direct current low voltage signal VSSG2 to reset a potential of the pull-up control signal point Qn according to the initial signal STV and the second direct current low voltage signal VSSG2 after the gate driver on array circuit operates for one cycle;

the first pull-down holding circuit comprises: an eighth thin film transistor (T43-1), a ninth thin film transistor (T33-1), a tenth thin film transistor (T43-2), an eleventh thin film transistor (T33-2), a twelfth thin film transistor (T43-3) and a thirteenth thin film transistor (T33-3);

a control end of the eighth thin film transistor (T43-1) is inputted with the n+5th stage clock signal CK(n+5), and a first end of the eighth thin film transistor is electrically connected to the pull-up control signal point Qn, and a second end of the eighth thin film transistor is inputted with the n−4th stage transfer signal ST(n−4), and the eighth thin film transistor (T43-1) to hold the pull-up control signal Q(n) in the off state according to the n+5th stage clock signal CK(n+5) and the n−4th stage transfer signal ST(n−4); a control end of the ninth thin film transistor (T33-1) is inputted with the n+5th stage clock signal CK(n+5), and a first end of the ninth thin film transistor is electrically connected to the nth stage horizontal scanning line Gn, and a second end of the ninth thin film transistor is inputted with the first direct current low voltage signal VSSQ1, and the ninth thin film transistor (T33-1) holds the nth stage scan driving signal G(n) in the off state according to the n+5th stage clock signal CK(n+5) and the first direct current low voltage signal VSSQ1; a control end of the tenth thin film transistor (T43-2) inputs an n+6th stage clock signal CK(n+6), and a first end of the tenth thin film transistor is electrically connected to the pull-up control signal point Qn, and a second of the tenth thin film transistor is inputted with the n−4th stage transfer signal ST(n−4), and the tenth thin film transistor (T43-2) holds the pull-up control signal Q(n) in the off state according to the n+6th stage clock signal CK(n+6) and the n−4th stage transfer signal ST(n−4); a control end of the eleventh thin film transistor (T33-3) is inputted with the n+6th stage clock signal CK(n+6), and a first end of the eleventh thin film transistor is electrically connected to the n+1th stage horizontal scanning line Gn+1, and a second end of the eleventh thin film transistor is inputted with the first direct current low voltage signal VSSQ1, and the eleventh thin film transistor (T33-3) holds the n+1th stage scan drive signal G(n+1) in the off state according to the n+6th stage clock signal CK(n+6) and the first direct current low voltage signal VSSQ1; a control end of the twelfth thin film transistor (T43-3) is inputted with the n+7th stage clock signal CK(n+7), and a first end of the twelfth thin film transistor is electrically connected to the pull-up control signal point Qn, and a second end of the twelfth thin film transistor is inputted with the n−4th stage transfer signal ST(n−4), and the twelfth thin film transistor (T43-3) holds the pull-up control signal Q(n) in the off state according to the n+7th stage clock signal CK(n+7) and the n−4th stage transfer signal ST(n−4); a control end of the thirteenth thin film transistor (T33-3) is inputted with the n+7th stage clock signal CK(n+7), a first end of the thirteenth thin film transistor is electrically connected to the n+2th stage horizontal scanning line Gn+2, a second end of the thirteenth thin film transistor is inputted with the first direct current low voltage signal VSSQ1, and the thirteenth thin film transistor (T33-3) holds the n+2th stage scan drive signal G(n+2) in the off state according to the n+7th stage clock signal CK(n+7) and the first direct current low voltage signal VSSQ1.

13. The liquid crystal display device according to claim 12, wherein the pull-down holding signal PDH is a direct current high voltage signal VGH;

the second pull-down holding circuit comprises: a fourteenth thin film transistor (T51), a fifteenth thin film transistor (T52), a sixteenth thin film transistor (T53), a seventeenth thin film transistor (T54), an eighteenth thin film transistor (T42), a nineteenth thin film transistor (T32-1), a twentieth thin film transistor (T32-2) and a twenty-first thin film transistor (T32-3); a control end and a first end of the fourteenth thin film transistor (T51) are inputted with the direct current high voltage signal VGH, and a second end of the fourteenth thin film transistor is electrically connected to a first signal point Nn; a control end of the fifteenth thin film transistor (T52) is electrically connected to the pull-up control signal point Qn, and a first end of the fifteenth thin film transistor is electrically connected to the first signal point Nn, and a second end of the fifteenth thin film transistor is inputted with the first direct current low voltage signal VSSQ1; a control end of the sixteenth thin film transistor (T53) is electrically connected to the first signal point Nn, and a first end of the sixteenth thin film transistor is inputted with the direct current high voltage signal VGH, and a second end of the sixteenth thin film transistor is electrically connected to a second signal point Pn, and a control end of the seventeenth thin film transistor (T54) is electrically connected to the pull-up control signal point Qn, and a first end of the seventeenth thin film transistor is electrically connected to the second signal point Pn, and a second end of the seventeenth thin film transistor is inputted with the first direct current low voltage signal VSSQ1; a control end of the eighteenth thin film transistor (T42) is electrically connected to the second signal point Pn, and a first end of the eighteenth thin film transistor is electrically connected to the pull-up control signal point Qn, and a second end of the eighteenth thin film transistor is inputted with the first direct current low voltage signal VSSQ1, and the eighteenth thin film transistor (T42) holds the pull-up control signal Q(n) in the off state according to the direct current high voltage signal VGH and the first direct current low voltage signal VSSQ1; a control end of the nineteenth thin film transistor (T32-1) is electrically connected to the second signal point Pn, and a first end of the nineteenth thin film transistor is electrically connected to the nth stage horizontal scanning line Gn, and a second end of the nineteenth thin film transistor is inputted with the second direct current low voltage signal VSSG2, and the nineteenth thin film transistor (T32-1) holds the nth stage scan driving signal G(n) in the off state according to the direct current high voltage signal VGH and the second direct current low voltage signal VSSG2; a control end of the twentieth thin film transistor (T32-2) is electrically connected to the second signal point Pn, and a first end of the twentieth thin film transistor is electrically connected to the n+1th stage horizontal scanning line Gn+1, and a second end of the twentieth thin film transistor is inputted with the second direct current low voltage signal VSSG2, and the twentieth thin film transistor (T32-2) holds the n+1th stage scan driving signal G(n+1) in the off state according to the direct current high voltage signal VGH and the second direct current low voltage signal VSSG2; a control end of the twenty-first thin film transistor (T32-3) is electrically connected to the second signal point Pn, and a first end of the twenty-first thin film transistor is electrically connected to the n+2th stage horizontal scanning line Gn+2, and a second end of the twenty-first thin film transistor is inputted with the second direct current low voltage signal VSSG2, and the twenty-first thin film transistor (T32-3) holds the n+2th stage scan driving signal G(n+2) in the off state according to the direct current high voltage signal VGH and the second direct current low voltage signal VSSG2.

14. The liquid crystal display device according to claim 12, wherein the pull-down holding signal PDH is a direct current high voltage signal VGH;

the second pull-down holding circuit comprises: a fourteenth thin film transistor (T51), a fifteenth thin film transistor (T52), a sixteenth thin film transistor (T53), a seventeenth thin film transistor (T54), an eighteenth thin film transistor (T42), a nineteenth thin film transistor (T32-1), a twentieth thin film transistor (T32-2), a twenty-first thin film transistor (T32-3) and a twenty-second thin film transistor (T42-1); a control end and a first end of the fourteenth thin film transistor (T51) are inputted with the direct current high voltage signal VGH, and a second end of the fourteenth thin film transistor is electrically connected to a first signal point Nn; a control end of the fifteenth thin film transistor (T52) is electrically connected to the pull-up control signal point Qn, and a first end of the fifteenth thin film transistor is electrically connected to the first signal point Nn, and a second end of the fifteenth thin film transistor is inputted with the first direct current low voltage signal VSSQ1; a control end of the sixteenth thin film transistor (T53) is electrically connected to the first signal point Nn, and a first end of the sixteenth thin film transistor is inputted with the direct current high voltage signal VGH, and a second end of the sixteenth thin film transistor is electrically connected to a second signal point Pn, and a control end of the seventeenth thin film transistor (T54) is electrically connected to the pull-up control signal point Qn, and a first end of the seventeenth thin film transistor is electrically connected to the second signal point Pn, and a second end of the seventeenth thin film transistor is inputted with the first direct current low voltage signal VSSQ1; a control end of the eighteenth thin film transistor (T42) is electrically connected to the second signal point Pn, and a first end and a second end of the eighteenth thin film transistor are electrically connected to the pull-up control signal point Qn; a control end and a first end of the twenty-second thin film transistor (T42-1) are electrically connected to the pull-up control signal point Qn, and a second end of the twenty-second thin film transistor is inputted with the first direct current low voltage signal VSSQ1, and the eighteenth thin film transistor (T42) and the twenty-second thin film transistor (T42-1) hold the pull-up control signal Q(n) in the off state according to the direct current high voltage signal VGH and the first direct current low voltage signal VSSQ1; a control end of the nineteenth thin film transistor (T32-1) is electrically connected to the second signal point Pn, and a first end of the nineteenth thin film transistor is electrically connected to the nth stage horizontal scanning line Gn, and a second end of the nineteenth thin film transistor is inputted with the second direct current low voltage signal VSSG2, and the nineteenth thin film transistor (T32-1) holds the nth stage scan driving signal G(n) in the off state according to the direct current high voltage signal VGH and the second direct current low voltage signal VSSG2; a control end of the twentieth thin film transistor (T32-2) is electrically connected to the second signal point Pn, and a first end of the twentieth thin film transistor is electrically connected to the n+1th stage horizontal scanning line Gn+1, and a second end of the twentieth thin film transistor is inputted with the second direct current low voltage signal VSSG2, and the twentieth thin film transistor (T32-2) holds the n+1th stage scan driving signal G(n+1) in the off state according to the direct current high voltage signal VGH and the second direct current low voltage signal VSSG2; a control end of the twenty-first thin film transistor (T32-3) is electrically connected to the second signal point Pn, and a first end of the twenty-first thin film transistor is electrically connected to the n+2th stage horizontal scanning line Gn+2, and a second end of the twenty-first thin film transistor is inputted with the second direct current low voltage signal VSSG2, and the twenty-first thin film transistor (T32-3) holds the n+2th stage scan driving signal G(n+2) in the off state according to the direct current high voltage signal VGH and the second direct current low voltage signal VSSG2.

15. The liquid crystal display device according to claim 12, wherein the pull-down holding signal PDH comprises a first low-frequency signal LC1 and a second low-frequency signal LC2, and the second pull-down holding circuit comprises a first pull-down holding module and a second pull-down holding module;

the first pull-down holding circuit comprises: a fourteenth thin film transistor (T51), a fifteenth thin film transistor (T52), a sixteenth thin film transistor (T53), a seventeenth thin film transistor (T54), an eighteenth thin film transistor (T42), a nineteenth thin film transistor (T32-1), a twentieth thin film transistor (T32-2) and a twenty-first thin film transistor (T32-3); a control end and a first end of the fourteenth thin film transistor (T51) are inputted with the first low frequency signal LC1, and a second end of the fourteenth thin film transistor is electrically connected to a first signal point Nn; a control end of the fifteenth thin film transistor (T52) is electrically connected to the pull-up control signal point Qn, and a first end of the fifteenth thin film transistor is electrically connected to the first signal point Nn, and a second end of the fifteenth thin film transistor is inputted with the first direct current low voltage signal VSSQ1; a control end of the sixteenth thin film transistor (T53) is electrically connected to the first signal point Nn, and a first end of the sixteenth thin film transistor is inputted with the first low frequency signal LC1, and a second end of the sixteenth thin film transistor is electrically connected to a second signal point Pn, and a control end of the seventeenth thin film transistor (T54) is electrically connected to the pull-up control signal point Qn, and a first end of the seventeenth thin film transistor is electrically connected to the second signal point Pn, and a second end of the seventeenth thin film transistor is inputted with the first direct current low voltage signal VSSQ1; a control end of the eighteenth thin film transistor (T42) is electrically connected to the second signal point Pn, and a first end of the eighteenth thin film transistor is electrically connected to the pull-up control signal point Qn, and a second end of the eighteenth thin film transistor is inputted with the first direct current low voltage signal VSSQ1, and the eighteenth thin film transistor (T42) holds the pull-up control signal Q(n) in the off state according to the direct current high voltage signal VGH and the first direct current low voltage signal VSSQ1; a control end of the nineteenth thin film transistor (T32-1) is electrically connected to the second signal point Pn, and a first end of the nineteenth thin film transistor is electrically connected to the nth stage horizontal scanning line Gn, and a second end of the nineteenth thin film transistor is inputted with the second direct current low voltage signal VSSG2, and the nineteenth thin film transistor (T32-1) holds the nth stage scan driving signal G(n) in the off state according to the direct current high voltage signal VGH and the second direct current low voltage signal VSSG2; a control end of the twentieth thin film transistor (T32-2) is electrically connected to the second signal point Pn, and a first end of the twentieth thin film transistor is electrically connected to the n+1th stage horizontal scanning line Gn+1, and a second end of the twentieth thin film transistor is inputted with the second direct current low voltage signal VSSG2, and the twentieth thin film transistor (T32-2) holds the n+1th stage scan driving signal G(n+1) in the off state according to the direct current high voltage signal VGH and the second direct current low voltage signal VSSG2; a control end of the twenty-first thin film transistor (T32-3) is electrically connected to the second signal point Pn, and a first end of the twenty-first thin film transistor is electrically connected to the n+2th stage horizontal scanning line Gn+2, and a second end of the twenty-first thin film transistor is inputted with the second direct current low voltage signal VSSG2, and the twenty-first thin film transistor (T32-3) holds the n+2th stage scan driving signal G(n+2) in the off state according to the direct current high voltage signal VGH and the second direct current low voltage signal VSSG2;

the second pull-down holding module includes: a twenty-third thin film transistor (T61), a twenty-fourth thin film transistor (T62), a twenty-fifth thin film transistor (T63), and a twenty-sixth thin film transistor (T64), a twenty-seventh thin film transistor (T44), a twenty-eighth thin film transistor (T34-1), a twenty-ninth thin film transistor (T34-2) and a thirtieth thin film transistor (T34-3); a control end and a first end of the twenty-third thin film transistor (T61) are inputted with the second low frequency signal LC2, and a second end of the twenty-third thin film transistor is electrically connected to a third signal point Sn; a control end of the twenty-fourth thin film transistor (T62) is electrically connected to the pull-up control signal point Qn, a first end of the twenty-fourth thin film transistor is electrically connected to the third signal point Sn, and a second end of the twenty-fourth thin film transistor is input to the first direct current low voltage signal VSSQ1; a control end of the twenty-fifth thin film transistor (T63) is electrically connected to the third signal point Sn, and a first end of the twenty-fifth thin film transistor is inputted with the second low frequency signal LC2, and a second end of the twenty-fifth thin film transistor is electrically connected to a fourth signal point Kn; a control end of the twenty-sixth thin film transistor (T64) is electrically connected to the pull-up control signal point Qn, and a first end of the twenty-sixth thin film transistor is electrically connected to the fourth signal point Kn, and a second end of the twenty-sixth thin film transistor is inputted with the first direct current low voltage signal VSSQ1; a control end of the twenty-seventh thin film transistor (T44) is electrically connected to the fourth signal point Kn, and a first end of the twenty-seventh thin film transistor is electrically connected to the pull-up control signal point Qn, and a second end of the twenty-seventh thin film transistor is inputted with the first direct current low voltage signal VSSQ1, and the twenty-seventh thin film transistor (T44) holds the pull-up control signal Q(n) in the off state according to the second low frequency signal LC2 and the first direct current low voltage signal VSSQ1; a control end of the twenty-eighth thin film transistor (T34-1) is electrically connected to the fourth signal point Kn, and a first end of the twenty-eighth thin film transistor is electrically connected to the nth stage horizontal scanning line Gn, and a second end of the twenty-eighth thin film transistor is inputted with the second direct current low voltage signal VSSG2, and the twenty-eighth thin film transistor (T34-1) holds the nth stage scan driving signal G(n) in the off state according to the second low frequency signal LC2 and the second direct current low voltage signal VSSG2; a control end of the twenty-ninth thin film transistor (T34-2) is electrically connected to the fourth signal point Kn, and a first end of the twenty-ninth thin film transistor is electrically connected to the n+1th stage horizontal scanning line Gn+1, and a second end of the twenty-ninth thin film transistor is inputted with the second direct current low voltage signal VSSG2, and the twenty-ninth thin film transistor (T34-2) holds the n+1th stage scan driving signal G(n+1) according to the second low frequency signal LC2 and the second direct current low voltage signal VSSG2; a control end of the thirtieth thin film transistor (T34-3) is electrically connected to the fourth signal point Kn, and a first end of the thirtieth thin film transistor is electrically connected to the n+2th stage horizontal scanning line Gn+2, and a second end of the thirtieth thin film transistor is inputted with the second direct current low voltage signal VSSG2, and the thirtieth thin film transistor (T34-3) holds the n+2th stage scan driving signal G(n+2) according to the fourth signal point Kn and the second direct current low voltage signal VSSG2.

16. The liquid crystal display device according to claim 15, wherein the first pull-down holding module and the second pull-down holding module alternately function to hold the pull-up control signal Q(n), the nth stage scan driving signal G(n), the n+1th stage scan driving signal G(n+1) and the n+2th stage scan driving signal G(n+2) in the off state.

* * * * *